US012543778B2

(12) United States Patent
Selby et al.

(10) Patent No.: US 12,543,778 B2
(45) Date of Patent: Feb. 10, 2026

(54) SMOKING ARTICLE

(71) Applicant: Altria Client Services LLC, Richmond, VA (US)

(72) Inventors: Ryan Daniel Selby, Vancouver (CA); Ryan Karkairan, Vancouver (CA)

(73) Assignee: Altria Client Services LLC, Richmond, VA (US)

( * ) Notice: Subject to any disclaimer, the term of this patent is extended or adjusted under 35 U.S.C. 154(b) by 697 days.

(21) Appl. No.: 17/438,322

(22) PCT Filed: Mar. 11, 2020

(86) PCT No.: PCT/CA2020/000038
§ 371 (c)(1),
(2) Date: Sep. 10, 2021

(87) PCT Pub. No.: WO2020/181358
PCT Pub. Date: Sep. 17, 2020

(65) Prior Publication Data

US 2022/0183348 A1 Jun. 16, 2022

Related U.S. Application Data

(60) Provisional application No. 62/816,770, filed on Mar. 11, 2019.

(51) Int. Cl.
*A24D 1/20* (2020.01)
*A24B 3/14* (2006.01)
(Continued)

(52) U.S. Cl.
CPC ..... *A24D 1/20* (2020.01); *A24B 3/14* (2013.01); *A24C 5/01* (2020.01); *A24C 5/606* (2013.01); *A24D 3/043* (2013.01); *A24D 3/17* (2020.01)

(58) Field of Classification Search
None
See application file for complete search history.

(56) References Cited

U.S. PATENT DOCUMENTS 3,356,094 A 12/1967 Drummond et al.
4,995,407 A 2/1991 Kossiakoff et al.
(Continued)

FOREIGN PATENT DOCUMENTS

CN 88101196 A 9/1988
CN 104039183 A 9/2014
(Continued)

OTHER PUBLICATIONS

International Search Report and Written Opinion from corresponding International Application No. PCT/CA2020/000038 dated Jul. 28, 2020, 17 pages.
(Continued)

*Primary Examiner* — Philip Y Louie
*Assistant Examiner* — Nicole A Szumigalski
(74) *Attorney, Agent, or Firm* — Harness, Dickey & Pierce, P.L.C.

(57) ABSTRACT

An improved, cleaner functioning smoking article is provided, comprising a aerosol forming substrate engineered to include airflow channels. Features include a hollow tube, which may be comprised of various materials, including the material for vaporization itself, within the engineered material, such as tobacco, for efficient vaporization. Other features include a hollow, inverted cone to permit air ingress in a closed bottomed HNB cigarette, and a capsule cigarette designed to retain loose leaf and original material for clean vaporization.

16 Claims, 30 Drawing Sheets

(51) Int. Cl.

| | |
|---|---|
| ***A24C 5/01*** | (2020.01) |
| ***A24C 5/60*** | (2006.01) |
| ***A24D 3/04*** | (2006.01) |
| ***A24D 3/17*** | (2020.01) |

(56) References Cited

U.S. PATENT DOCUMENTS

| | | | | |
|---|---|---|---|---|
| 5,666,976 | A | 9/1997 | Adams et al. | |
| 5,944,025 | A | 8/1999 | Cook et al. | |
| 5,954,061 | A * | 9/1999 | Cardarelli | A24D 1/00 131/201 |
| 2004/0020500 | A1 | 2/2004 | Wrenn et al. | |
| 2006/0191546 | A1 | 8/2006 | Takano et al. | |
| 2009/0014020 | A1* | 1/2009 | Yoss | A24D 3/17 131/340 |
| 2010/0275935 | A1* | 11/2010 | Fiebelkorn | A24D 1/02 131/365 |
| 2015/0040924 | A1 | 2/2015 | Mironov et al. | |
| 2016/0044966 | A1 | 2/2016 | Li et al. | |
| 2016/0324215 | A1 | 11/2016 | Mironov et al. | |
| 2017/0119049 | A1* | 5/2017 | Blandino | H05B 3/34 |
| 2018/0177235 | A1 | 6/2018 | Minzoni et al. | |
| 2018/0310623 | A1 | 11/2018 | Batista | |
| 2018/0338520 | A1 | 11/2018 | Sutton et al. | |
| 2019/0090533 | A1 | 3/2019 | Norfleet et al. | |

FOREIGN PATENT DOCUMENTS

| | | | | |
|---|---|---|---|---|
| CN | 205658371 | U | 10/2016 | |
| CN | 108685174 | A | 10/2018 | |
| EP | 0174645 | A2 | 3/1986 | |
| EP | 2688430 | A1 | 1/2014 | |
| GB | 2534208 | A | 7/2016 | |
| JP | 2012065633 | A | 4/2012 | |
| KR | 20190050341 | A | 5/2019 | |
| WO | WO-2017198837 | A1 * | 11/2017 | A24D 1/00 |
| WO | WO-2019/030277 | A1 | 2/2019 | |
| WO | 201957939 | A1 | 3/2019 | |

OTHER PUBLICATIONS

Chinese Office Action for Application No. 202080017205.4, dated Jun. 17, 2024, with English Translation included.

Chinese Office Action for Application No. 202080017205.4, dated Oct. 11, 2023, with English Translation included.

Extended European Search Report dated Feb. 22, 2023.

European Communication pursuant to Rule 164(1) mailed Nov. 16, 2022.

Chinese Office Action for Application No. 202080017205.4, dated Dec. 19, 2024, with English Translation included.

European Office Action for Application No. 20769702.0, dated Jan. 28, 2025.

Chinese Notification of Reexamination for Application No. 202080017205.4, dated Jun. 30, 2025, with English Translation included.

* cited by examiner

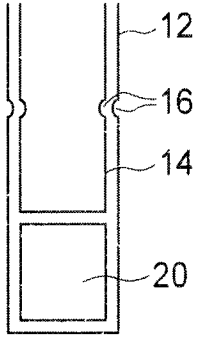
FIG. 37A
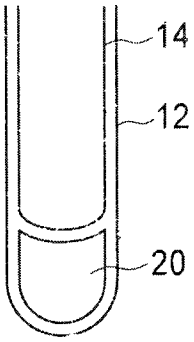
FIG. 37B
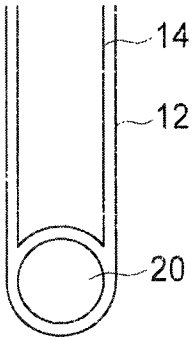
FIG. 37C
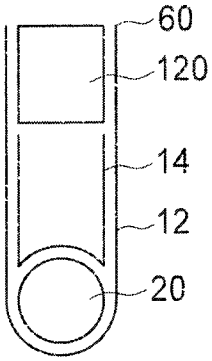
FIG. 37D
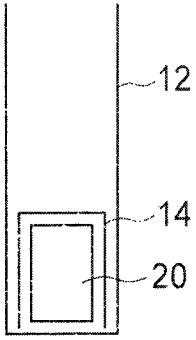
FIG. 37E
FIG. 37F
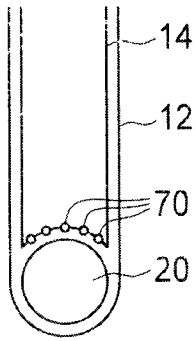
FIG. 37G
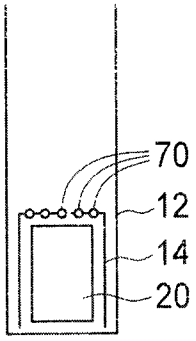
FIG. 37H
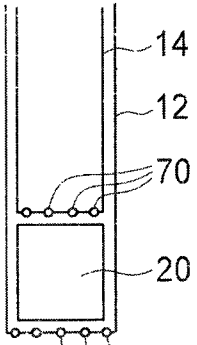
FIG. 37I
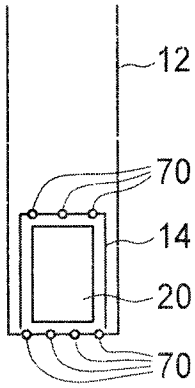
FIG. 37J
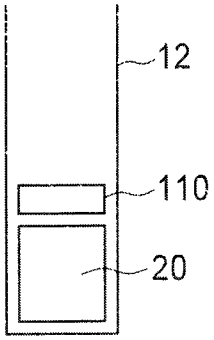
FIG. 37K
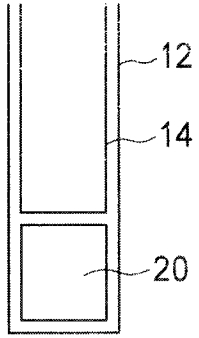
FIG. 37L

SMOKING ARTICLE

FIELD

Embodiments of the invention generally relate to electrical smoking systems comprising aerosol generating substrates, and more specifically relate to aerosol generating substrates adapted to reduce the overall thermal mass of aerosol generating substrates or to modify an airflow through the aerosol generating substrate.

BACKGROUND

Electrical smoking systems, also known as Heat-not burn (HNB) devices, generally heat aerosol forming substrates rather than igniting and burning them. The heating process generates aerosols from aerosol-generating substrates which may be visible or invisible, and the aerosols generated may include vapors, gases, and liquid droplets. Absent combustion of the aerosol generating substrates, the levels of harmful chemicals may potentially be significantly reduced compared to aerosols created by burning and combustion, such as smoke.

As used herein, the term HNB devices refers to Heat-not-burn aerosol generating devices which generally use an electric heating element to produce aerosols from aerosol generating substrates, although there are other methods for heating the aerosol generating substrates, such as by combustion or by combining different chemicals to generate heat from exothermic chemical reactions, and the use herein of the term HNB devices generally relates to all such devices intended for heating aerosol generating substrates. HNB devices, when used with suitable aerosol generating substrates, may match some of the behavioral aspects of conventional smoking. Known HNB devices use loose-leaf tobacco in a heated chamber, others require product-specific cigarettes, or HNB cigarettes. As used herein, the term HNB cigarette refers to smoking articles that comprise at least one aerosol generating substrate designed to be heated by an HNB device, rather than ignited and combusted as a traditional cigarette.

Commonly, HNB cigarettes comprise the following sections:

1. A section containing an aerosol generating substrate, which commonly comprises a reconstituted tobacco film made from a dried tobacco suspension. Such a suspension usually comprises 70% tobacco, humectants (water and glycerin) to encourage wet steam formation, binding agents, and aroma agents;
2. A hollow tube;
3. A filter; and
4. A mouthpiece.

Prior art HNB cigarettes include an aerosol generating substrate section connected to a hollow tube, a filter, and a mouthpiece, connected in a series, or in a linear, consecutive fashion in an axial alignment. After the aerosol generating section has been sufficiently heated by the HNB device, as an operator inhales, aerosols generated from the aerosol generating substrate travel through the aerosol generating substrate section, exit the aerosol generating substrate section, then travel through a hollow tube, through a filter section, and then the aerosol exits the HNB cigarette through a mouthpiece to be inhaled by the user.

Many HNB cigarettes comprise an aerosol generating substrate section that is comprised of a reconstituted tobacco film. Reconstituted tobacco films are usually of a uniform thickness and are formed into a tubular section with the same diameter as that of the HNB cigarette. In operation, the HNB cigarette is placed into an HNB device, and the reconstituted tobacco film portion of the HNB cigarette is positioned proximally to a heating element contained within the HNB device. The heating element creates sufficient heat to heat the aerosol generating substrate, which causes the formation of aerosols within the aerosol forming substrate. In a common embodiment, the heating element of the HNB device is positioned so that upon insertion of the HNB cigarette into the HNB device, the heating element is external to the aerosol generating substrate. The heating element, being exterior to the aerosol generating substrate, heats the aerosol generating substrate from the outside, towards the inside.

A common problem of such outside heating in HNB devices is that the aerosol generating substrate within the interior or middle of the HNB cigarette is exposed to less heat than the aerosol generating substrate adjacent to its exterior surface. Accordingly, the aerosol generating substrate within the interior or middle of the HNB cigarette may not be heated to sufficient temperatures to adequately produce aerosols within the interior or the middle of the HNB cigarette, and thus the aerosol generating substrate may not be evenly heated, as aerosol generating substrates generally have a relatively high thermal mass (high heat capacity and density, with a low level of reflectivity).

Some prior art HNB devices attempt to address the above shortcomings by not heating the aerosol generating substrate by using a conventional heating oven surrounding the exterior of the HNB cigarette, but rather with an internal style heating element, that commonly is in the form of a pin or blade, which is inserted up into or stabbed into the aerosol generating substrate contained in the open end of an HNB cigarette. However, the interior style prior art heating elements generally do not overcome the high thermal mass of the aerosol generating substrates to uniformly heat the aerosol generating substrates sufficiently to uniformly produce aerosols from the aerosol producing substrates.

Another common problem of HNB cigarettes is that it is difficult to control the air flow through the aerosol generating substrate section, which generally results in more restrictive air flow through the aerosol generating substrate section. Some prior art HNB cigarettes attempt to address these shortcomings through the use of specially designed aerosol forming substrates, such as reconstituted tobacco films, however even those methods do not adequately address the problems associated with the restriction of airflow.

Furthermore, prior art HNB cigarettes are open bottomed, which permits contaminates (including oils and fine particulates) to fall from the open end of the HNB cigarette onto or into the heating element (for HNB devices with heating elements that are external to the HNB cigarette) or onto the heating element stabbed into the aerosol generating sections (for HNB device with heating elements such as pins or blades that are internal to the HNB cigarette) or into or onto or around the chamber enclosing the heating element. Additionally, open bottomed HNB cigarettes are generally not appropriate for loose aerosol generating substrates (such as loose-leaf tobacco or other loose materials), because the material can easily fall out of the open end of the HNB cigarette onto or into the heating element or into or onto or around the chamber enclosing the heating element.

An additional problem faced by the prior art HNB cigarettes is the high temperature of the aerosol as it exits the mouthpiece of the HNB cigarette, which can cause burning or discomfort during use to the mouth or lips of an operator. Some prior art HNB cigarettes utilize a polymer film disposed within the HNB cigarette to cool the aerosol, while other prior art HNB cigarettes utilize perforations near the mouthpiece in order to mix cooler external air with the aerosol, however such solutions are not optimal because they either increase the cost of the HNB cigarette, dilute the aerosol which can result in undesirable aerosol qualities, or necessitate the inclusion of non-biodegradable or non-recyclable components in the HNB cigarette. Most prior art HNB cigarettes require the use of specially designed aerosol forming substrates (such as reconstituted tobacco films) in order to properly function, and loose aerosol forming substrates (such as original loose-leaf tobacco) cannot generally be used in prior art HNB cigarettes.

There is a need for an HNB cigarette that: reduces the high thermal mass of the aerosol forming substrate; provides a method for controlling the airflow through the aerosol forming substrate; prevents contaminants from falling into or onto or around the heating element or heating chamber of the HNB device; provides an optimal method for cooling the aerosol prior to inhalation by an operator; and permits loose aerosol forming substrates to be used in the HNB cigarette.

SUMMARY

An aerosol forming substrate for a smoking article including at least one air channel is disclosed. The air channel may be disposed on the outside of the aerosol forming substrate and may be comprised of least one sheet of reconstituted tobacco rolled to form a substantially cylindrical tube disposed substantially longitudinally through the aerosol forming substrate. The aerosol forming substrate may be loosely wrapped in multiple layers, thereby creating multiple air channels, with one or more hollow tubes in the aerosol forming substrate. The hollow tubes may be perforated. The smoking article may also include a hollow cone disposed within the smoking article. Air inflow access may be restricted or prevented at the distal end of the smoking article and air inflow may be provided by perforations on the side of the smoking article.

A reversible smoking article is disclosed with at least one aerosol forming substrate disposed between two mouthpieces located at opposite ends of the smoking article. The mouthpieces, filters and aerosol generating substrates may have different parameters and flavourings.

A cigarette comprising dual, open ended coaxially nested capsules for retaining aerosol generating substrates which may include original or loose leaf dried plant material such as tobacco, is disclosed. The open ended capsules may have perforations on the ends, and the ends may be flat, dome shaped, convex or concave.

A method of constructing a heat not burn cigarette is also disclosed, with the steps of: Attaching a porous filter at each end of a solid filter; Attaching a hollow tobacco rod to the exposed end of each porous filter; Attaching a hollow tube to the exposed end of each hollow tobacco rod to form a longitudinally disposed assembly; Wrapping the length of the first assembly in a covering wrap (tipping paper); Perforating the covering wrap and hollow tube circumferentially on the side surface at each end; Severing the first assembly in the middle; Rotating the two halves 180 degrees in opposite directions; Inserting a filter section, at least one hollow filter section, and two hollow cones; Wrapping the second assembly in a covering wrap; and Severing the second assembly in the middle, thereby forming two heat not burn cigarettes.

BRIEF DESCRIPTION OF THE DRAWINGS

FIG. 37A illustrates a HNB cigarette with an inner capsule with a blunt face and an outer capsule with a convex head in accordance with at least one example embodiment.

FIG. 37B illustrates a HNB cigarette with an inner capsule with a convex face and an outer capsule with a convex head in accordance with at least one example embodiment.

FIG. 37C illustrates a HNB cigarette with an inner capsule with a concave face and an outer capsule with a convex head in accordance with at least one example embodiment.

FIG. 37D illustrates the HNB cigarette of FIG. 37C with a filter in accordance with at least one example embodiment.

FIG. 37E illustrates a HNB cigarette with an inner capsule oriented with an open end adjacent to a closed end of an outer capsule in accordance with at least one example embodiment.

FIG. 37F illustrates a HNB cigarette with locking nubs configured to hold an inner capsule with a blunt face in place relative to and an outer capsule with a blunt head in accordance with at least one example embodiment.

FIG. 37G illustrates a HNB cigarette with perforations on an inner capsule in accordance with at least one example embodiment.

FIG. 37H illustrates another HNB cigarette with perforations on an inner capsule in accordance with at least one example embodiment.

FIG. 37I illustrates a HNB cigarette with perforations on an inner capsule and an outer capsule in accordance with at least one example embodiment.

FIG. 37J illustrates another HNB cigarette with perforations on an inner capsule and an outer capsule in accordance with at least one example embodiment.

FIG. 37K illustrates a HNB cigarette with an outer capsule and a screen in accordance with at least one example embodiment.

FIG. 37L illustrates a HNB cigarette with two open ended capsules in accordance with at least one example embodiment.

DETAILED DESCRIPTION

Figure 1A:
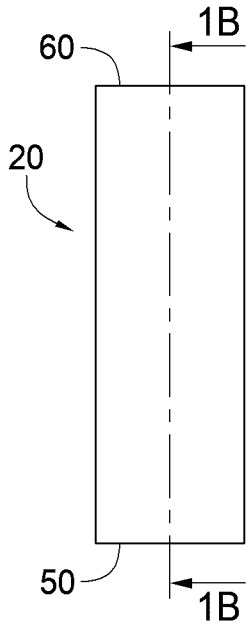
FIG. 1A is a front view of a tobacco section for use in a HNB cigarette in accordance with at least one example embodiment.

An improved design for a section of aerosol forming substrate to be used in an HNB cigarette for reducing the thermal mass of the aerosol forming substrate and increasing the airflow through the mass of the aerosol forming substrate, is provided. A reduction in thermal mass and increased airflow is achieved by engineering the aerosol forming substrate 20 to provide tubes, grooves or channels disposed within, throughout, or on the surface the aerosol forming substrate 20 ("substrate"). The substrate may be constructed from a slurry, sheet, strips, plug, or block of reconstituted material, or it may be formed by rolling or otherwise assembling the substrate 20 from sheets of reconstituted aerosol forming substrate, which may be layered, mixed, or combined with other materials which provide improved airflow or thermal transfer and may or may not be aerosol forming. Some materials could include a fiberglass mat, a porous material, or a filter material, for instance.

The present inventions herein disclosed may also be used with a combination-style heater, which as herein disclosed consists of both a first internal heating element disposed within a second external heating element. The use of a combination style heater may be advantageous in order to overcome the challenge of evenly heating both the interior and exterior of the aerosol generating substrate. The combination heater, as herein disclosed, is advantageous over prior art heaters. The internal heating element, which may consist of a pin, blade, or sword, may be heated using any known method for generating heat, including but not limited; using electric resistance to generate heat, using electromagnetic induction to generate heat, using combustion to generate heat, or by combining different chemicals to generate heat from exothermic chemical reactions. The external heating element, which may consist of a bowl, chamber, tube, or any other known structure, may be heated using any known method for generating heat, including but not limited; using electric resistance to generate heat, using electromagnetic induction to generate heat, using combustion to generate heat, or by combining different chemicals to generate heat from exothermic chemical reactions. In one embodiment of the combination heater, as disclosed herein, consists of an internal heating element positioned concentrically within an external heating element. In another embodiment, the internal heating element and the external heating element may be connected to the same control circuitry (either in series or in parallel), or they may be connected to independent control circuitry. In yet another embodiment, the internal heating element and the external heating element may be heated by the same type of heating method, or they may each be heated by different types heating methods. The internal heating element and the external heating element may be heated simultaneously, or they may be heated independently or sequentially. A heating program may be used to control both of the heating elements, either simultaneously, sequentially, or independently.

The present invention HNB cigarette does not require a polymer film to cool the vapor, nor does it require the use of reconstituted tobacco film. An HNB cigarette is exemplary in this description, but it should be read to include any smoking article, such as a pipe, cigar, cigarette, or vaporizer. It provides an apparatus and method to reduce the thermal mass of the tobacco-containing section. The present invention substantially reduces contamination of the heating element or heating chamber. It provides a plug of engineered tobacco incorporating integral air channels or grooves which maximize vapor production in the HNB cigarette and optimize the resulting flavor and mouth feel of the vapor for the consumer. The invention provides features including the shape of the plug, cone structures, and one or more internal hollow tubes to achieve increased efficiency and improved results from the HNB cigarette, in variations for both internally and externally heated embodiments.

Figure 1B:
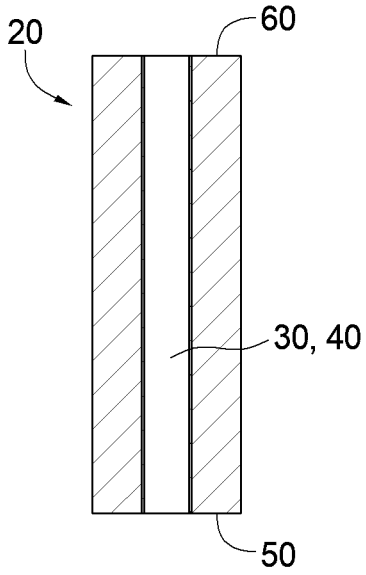
FIG. 1B is a cross-sectional view of the tobacco section of FIG. 1A taken along the line 1B-1B of FIG. 1A in accordance with at least one example embodiment.
Figure 1C:
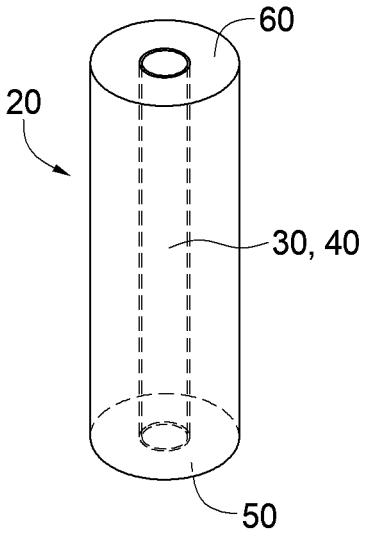
FIG. 1C is a perspective view of the tobacco section FIG. 1A in accordance with at least one example embodiment.

In an embodiment of the present invention, the HNB cigarette 10 has a housing or outer capsule 12, a mouthpiece 90, a hollow interior and a section for containing tobacco, including reconstituted tobacco film. As shown in FIGS. 1A to 1C the tobacco section 20 comprises at least one air flow channel 30, such as an inner tube 40 that extends from a bottom end 50 of the tobacco section 20 to a top end 60 of the tobacco section 20. The at least one air flow channel 30 is defined by the hollow tube 40, which may be manufactured with any known suitable material, including commonly used paper for making cigarettes. Suitable materials include cigarette paper, cellulose and modified cellulose products, fibrous materials with or without porosity such as cotton, flax, hemp, other fibers, or blends of fibers, or adhesives, or blends of different materials and adhesives. While the at least one air flow channel 30 is shown as being concentric with the tobacco section 20, alternate embodiments, as discussed below, comprise more than one air flow channel.

The at least one air flow channel 30 functions to introduce cooler air which is then mixed with hot tobacco vapor that is formed when the tobacco section 20 is heated to sufficient temperatures by a heating element when the tobacco section 20 is properly positioned within a heating element and an operator inhales, thereby obviating the need for a polymer film for cooling hot vapors in between the material to be vaporized and the user, as with prior art HNB cigarettes. The obviating of the polymer film provides the additional advantage over the known HNB cigarettes in that it reduces the environmental footprint of the HNB cigarette and can further be adapted to be fully recyclable and/or biodegradable.

Cooler, ambient, external air is drawn into the HNB cigarette as the operator inhales. The cooler air and the hot tobacco vapor then come together, combine or are comingled in the hollow tube 40 which is operatively and fluidly connected to the top end 60 (the top end being more proximate to the user in operation than the bottom end 50) of the tobacco section 20 to mix and lower the temperature of the hot tobacco vapors, prior to the tobacco vapors being inhaled by the operator. The mouthpiece 90 (not shown here) is disposed at the top end of the housing 12. The inner tube or tobacco tube disposed within the tobacco or other material 20 is optimally perforated with a plurality of holes, to permit air and vapor flow through the tobacco 20 into the tobacco tube 40 and into the mouth of the user.

Advantageously, the tobacco section 20 may be comprised of a rolled-up sheet of reconstituted tobacco. The inner tube 40 is then formed with the inside rolls of the rolled sheet (the inner roll may optimally be glued to form the tube 40). The outer layers of the roll have spaces between each layer which, in operation, permits air to be drawn through the layers in order to get the vapor out of the layers. The vapor is then drawn through the HNB cigarette 10 to the mouth of the user, in operation. One advantage of the tobacco itself forming the inner tube 40 and defining the pathway for the vapor in operation, is that less components are required, which is environmentally advantageous, and simpler to manufacture. The tobacco section 20 is disposable, and may be intended for one use only, so it is better to not include plastic or other foreign materials integrally in the tobacco section 20.

Tobacco section 20 may be formed from any substance capable of being heated so as to emit an aerosol or vapour. These substances may include tobacco, medicinal herbs and any other organic material capable of vaporization.

Additionally, the loose spiral structure provides for superior and even heating of the tobacco, as more surface area is exposed to the heating element(s) 170 (not shown here), whether a bayonet type heater stabs into the tobacco in operation, or heating elements are disposed about the tobacco, or a heating chamber 172 (not shown here) is used, or if a combination heater (consisting of an internal pin or blade type of heater used in conjunction with an external type of heater) is used.

Figure 28:
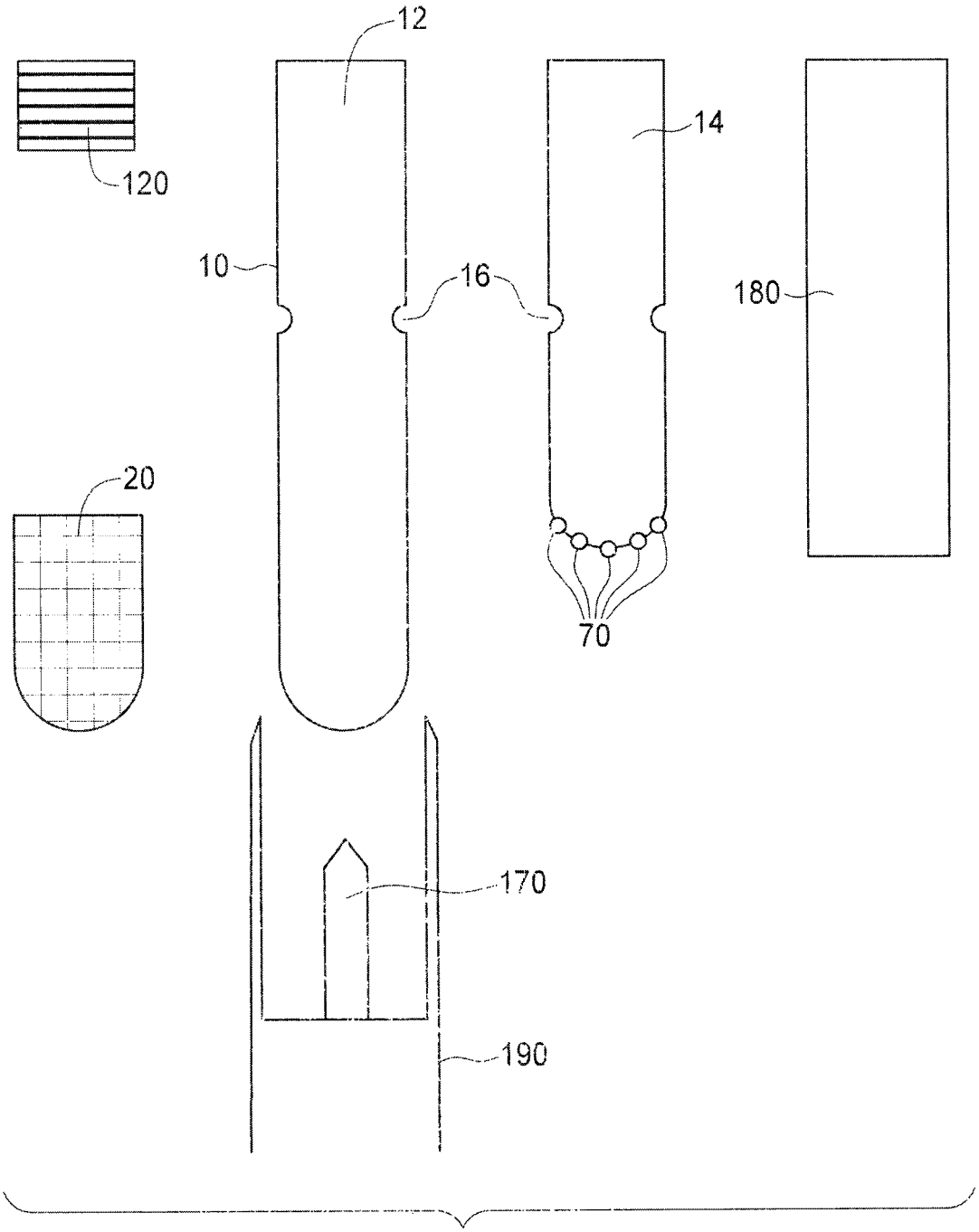
FIG. 28 is an exploded view of a closed end HNB cigarette and a heating device in accordance with at least one example embodiment.
Figure 29:
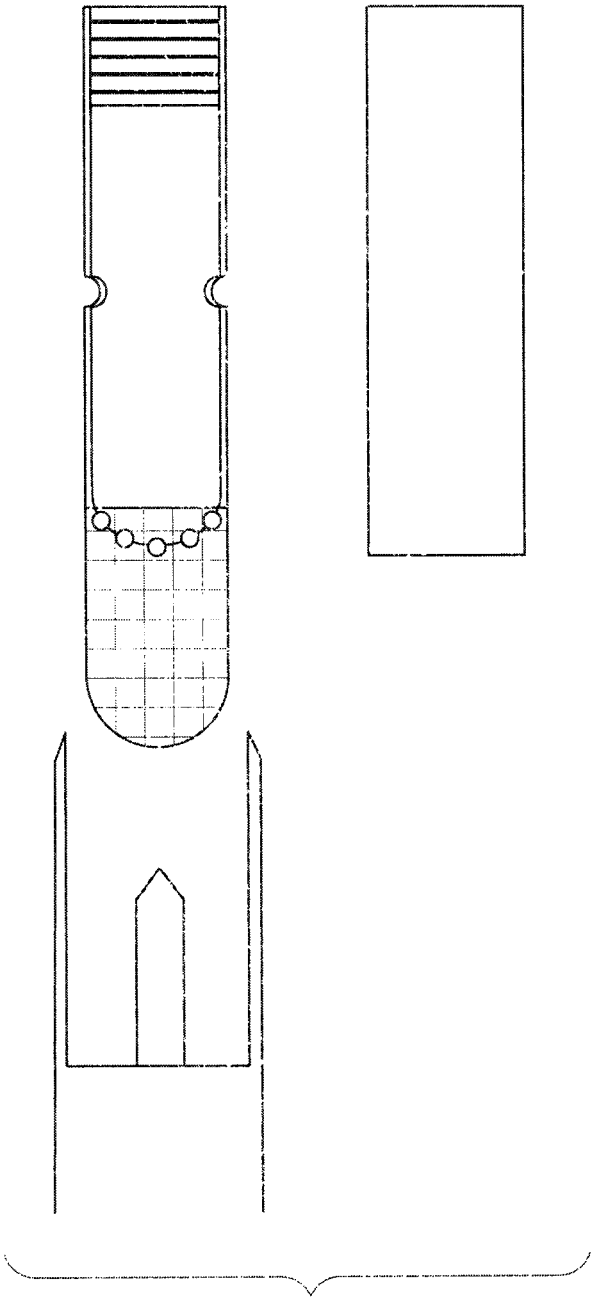
FIG. 29 is a partially exploded view of the HNB cigarette and the heating device of FIG. 28 in accordance with at least one example embodiment.
Figure 30:
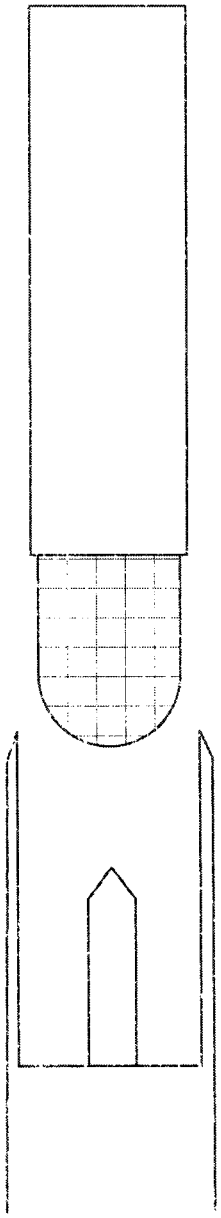
FIG. 30 is another partially exploded view of the HNB cigarette and the heating device of FIG. 28 in accordance with at least one example embodiment.
Figure 31:
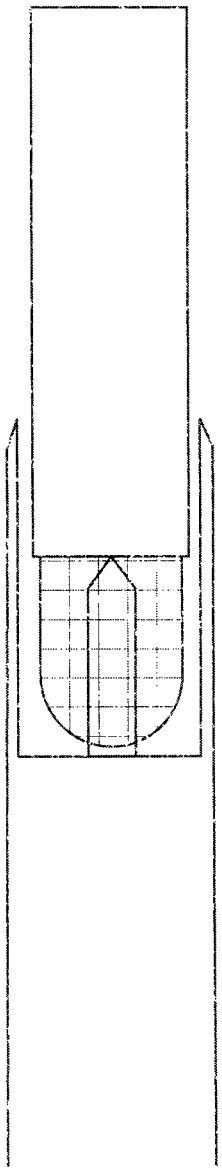
FIG. 31 is a front view of the closed end HNB cigarette of FIG. 28 coupled with the heating device in accordance with at least one example embodiment.

The outer layers of the tobacco roll 22 are not glued together, and thus they can be allowed to expand inside the cavity formed by the housing of the inner capsule (14) (see FIG. 28) thereby forming the spaces between the layers. The dual housings may also be called a pod or cigarette.

The reconstituted sheet of tobacco, in another embodiment, is rolled using the spiral wind technique and all of the layers are glued/fused together, with the winding creating airflow grooves on the outside of the roll, thereby allowing air to pass along the grooves to efficiently remove the vapor from the heated roll and channel it to the mouth of the user.

In an additional embodiment, the grooves are spiral wound and formed by winding a thin strip of tobacco creating airflow channels (resembling a barber pole or a candy cane or screw threads) so that the air travels along the valleys between the peaks formed by the strip of reconstituted tobacco.

In an additional embodiment, the sheet is parallel wound, with a series of diagonal slits cut out of the sheet before winding, which when the sheet with the slits is wound up, the slits overlap each other, thereby forming the spiral valleys for the airflow.

In a further embodiment, the grooves are formed by rolling the sheet in a particular way. Material is loosely wrapped in multiple layers, thereby creating multiple air channels.

In a further embodiment, the grooves are cut, including, optionally, machined, into the rolls after the rolls had already been wound (much like if you took the process for making a paper straw, and then used a machining process to cut airflow grooves into the outer surface of the straw). This process permits many different patterns of types of grooves to be cut so that the airflow and tobacco surface-area for heating is optimal.

In an additional embodiment, a formed tobacco plug is used. The tobacco section 20 is formed into specific shapes with cross-sections that may be shaped in many different ways such as stars, hexagons, squares, etc. (which may have one or more hollow sections in their interior) or other shapes that may have linear or spiral grooves in their exterior (and may have one or more hollow sections in their interior). These shapes provide for both air inflow and outflow, and may be formed by using a tobacco pulp forming process (similar to how thermoformed pulp paper products are made). The tobacco plug 20 shapes define grooves, tubes, holes, perforation, columns, or other features built directly into the tobacco section in order to optimize the air inflow/outflow and vapor production from the tobacco section 20.

The grooves are, optimally, longitudinal or through the entire length of the plug, to allow air or vapor to pass there through.

In another embodiment, the tobacco section 20 is made of small pelletized tobacco (or other specially engineered tobacco) which is loaded around the inner tube 40 after the inner tube 40 had been installed inside the inner capsule 14, or during the installation process. This configuration permits a thin outer capsule 12 approximately the diameter of a conventional cigarette to house all the HNB cigarette components and to operate as a closed bottom device, where the air inflow and outflow are both at, or near, the top end 60 of the device and the inflow. The air inflow may also be on a side of the device, for instance through circumferential perforations disposed on the sides of a device. An example of a thin or skinny stick HNB device is the GLO® product.

Figure 2A:
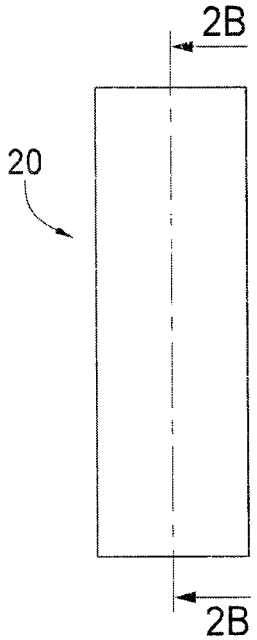
FIG. 2A is a front view of a tobacco section including a plurality of perforations in a tobacco tube for use in a HNB cigarette in accordance with at least one example embodiment.
Figure 2B:
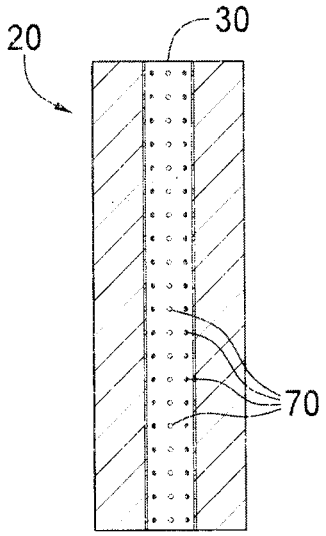
FIG. 2B is a cross-sectional view of the tobacco section of FIG. 2A taken along the line 2B-2B of FIG. 2A in accordance with at least one example embodiment.
Figure 2C:
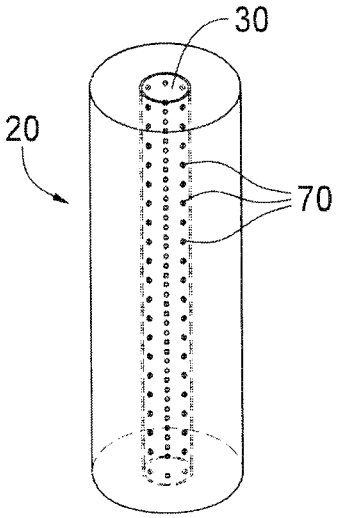
FIG. 2C is a perspective view of the tobacco section FIG. 2A in accordance with at least one example embodiment.

In an alternate embodiment, and as shown in FIGS. 2A to 2C, the at least one air flow channel 30 can further comprise a plurality of perforations 70 in the tobacco tube 40 which permits additional tobacco vapors to mix with the cooler air to be introduced into the HNB cigarette, allowing for further and finer temperature control of the tobacco vapors being inhaled, as well as further and finer control of the ratio of tobacco vapors to the cooler air inflow.

The at least one air flow channel 30 can be manufactured or defined by any known material, including commonly known cigarette papers. In an embodiment, a porous paper material can be used, and the additional and finer control of the tobacco vapor temperature and tobacco vapor to air ratio is controlled by the porosity of the paper, and the size of the pores in the paper. This obviates the need for making perforations 70 in the tobacco section 20.

Figure 3A:
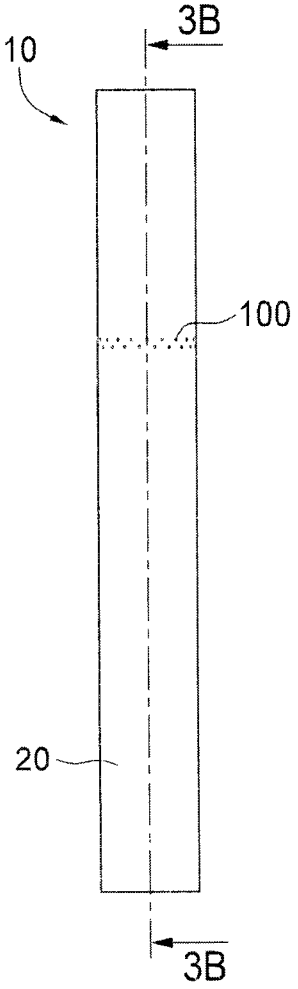
FIG. 3A is a front view of a HNB cigarette including the tobacco section of FIG. 1A in accordance with at least one example embodiment.
Figure 3B:
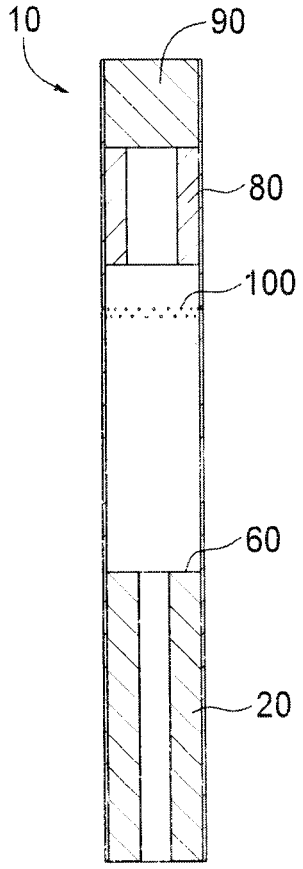
FIG. 3B is a cross-sectional view of the HNB cigarette of FIG. 3A taken along the line 3B-3B of FIG. 3A in accordance with at least one example embodiment.
Figure 3C:
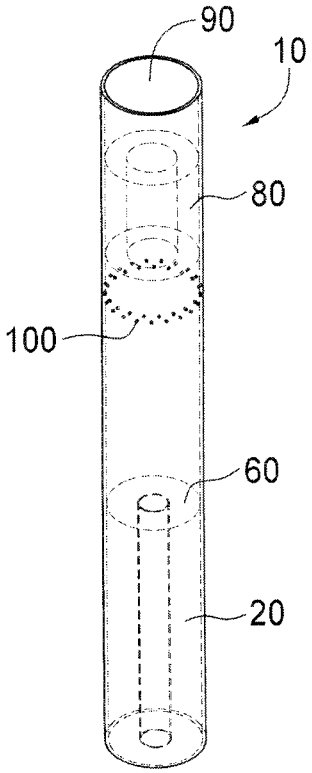
FIG. 3C is a perspective view of the HNB cigarette of FIG. 3A in accordance with at least one example embodiment.

In an alternate embodiment, and as shown in FIGS. 3A to 3C, an embodiment of the HNB cigarette 10 provides the tobacco section 20 operatively and fluidly connected to a hollow tube 80 at a top end 60 thereof, and a mouthpiece 90 operatively and fluidly connected to the outflow tube or hollow tube 80. As shown, the at least one air flow channel 30 does not have perforations 70 for introducing cooler air, but rather, the hollow tube 80 may have exterior or a second set of perforations 100 that permits the introduction of cooler air for cooling hot tobacco vapor during operation.

Figure 4A:
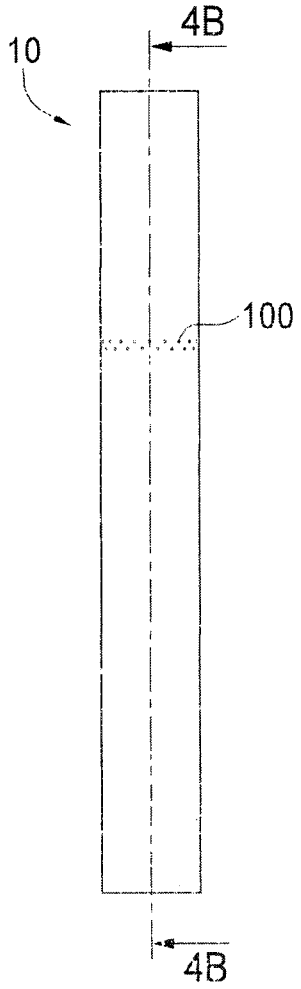
FIG. 4A is a front view of a HNB cigarette including the tobacco section of FIG. 1A and a porous material in accordance with at least one example embodiment.
Figure 4B:
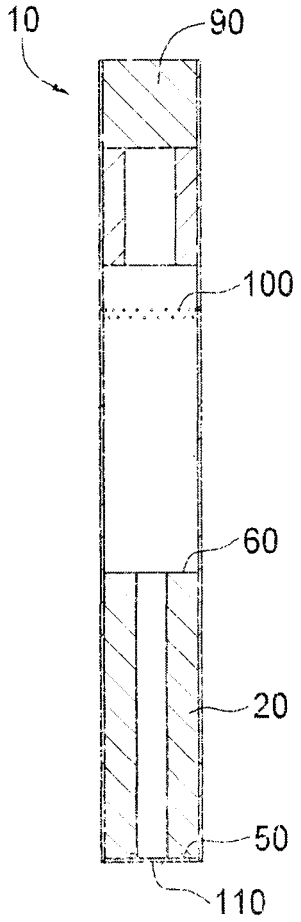
FIG. 4B is a cross-sectional view of the HNB cigarette of FIG. 4A taken along the line 4B-4B of FIG. 4A in accordance with at least one example embodiment.
Figure 4C:
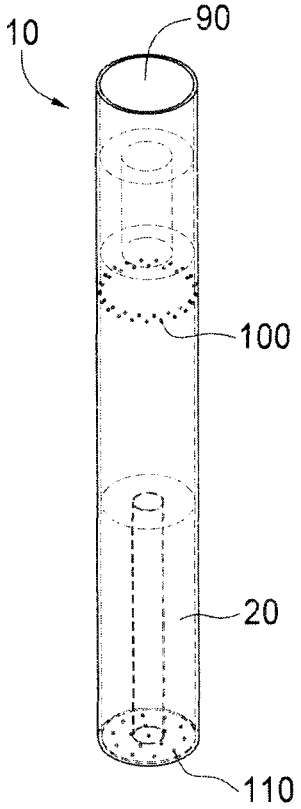
FIG. 4C is a perspective view of the HNB cigarette of FIG. 4A in accordance with at least one example embodiment.

In an embodiment wherein loose tobacco leaves are heated, as opposed to a reconstituted tobacco film, a porous material 110 such as cellulose acetate, cotton fibres, hemp fibres, flax fibres, or other suitable porous materials or a blend of suitable materials (but optimally is cellulose acetate) is attached to the bottom end of the tobacco section 20 to retain the tobacco material within the tobacco section 20. With reference to FIGS. 4A to 4C, the porous material 110 is attached to the bottom end 50 and still permits air to travel into the tobacco section 20, while retaining the tobacco material therein. The porous material 110 is advantageous, particularly when loose tobacco or other loose leaf or original material is used in the HNB cigarette. The porous material 110 further functions to retain most contaminants and/or residual products formed during vaporization of the tobacco material and thereby preventing contamination of the heating element or heating chamber of the vaporizer. This significantly reduces the amount of cleaning required to keep the heating element of the HNB device operating effectively.

Figure 5A:
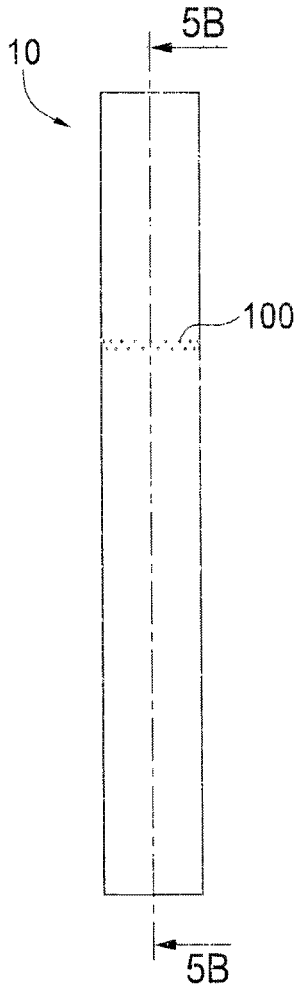
FIG. 5A is a front view of a HNB cigarette including the tobacco section of FIG. 2A in accordance with at least one example embodiment.
Figure 5B:
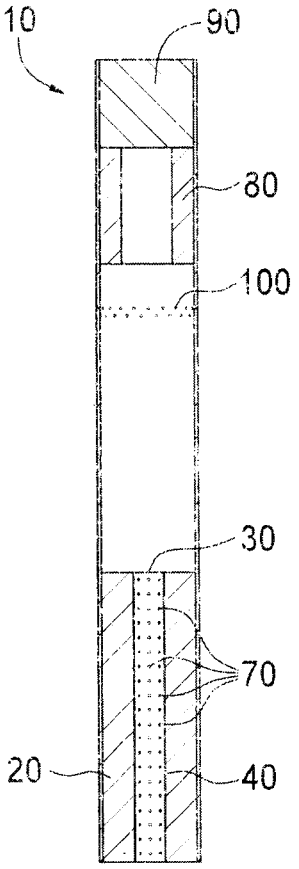
FIG. 5B is a cross-sectional view of the HNB cigarette of FIG. 5A taken along the line 5B-5B of FIG. 5A in accordance with at least one example embodiment.
Figure 5C:
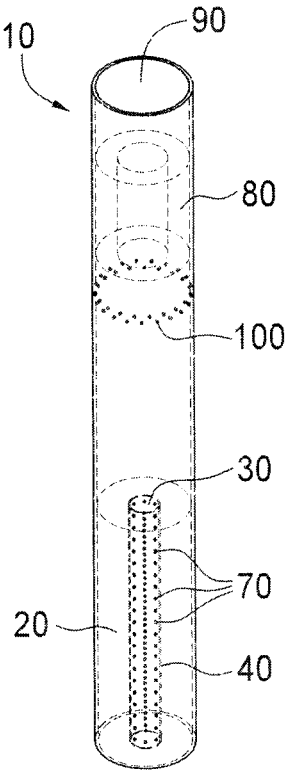
FIG. 5C is a perspective view of the HNB cigarette of FIG. 5A in accordance with at least one example embodiment.

FIGS. 5A to 5C illustrates an embodiment where the at least one air flow channel 30 is defined by a hollow tube 40 comprising perforations 70, and wherein the outflow tube or hollow tube 80 is adjacent or proximate to and is fluidly connected to the second set of perforations 100, which are disposed, optimally, in a circumferential ring in an axial manner about the housing or outer capsule 12, permitting air to flow into the cigarette from the sides as well as the bottom end 50. FIGS. 5A to 5C depict the second set of perforations 100 which provides additional control of cooler, ambient air entering into the HNB cigarette 10.

Figure 6A:
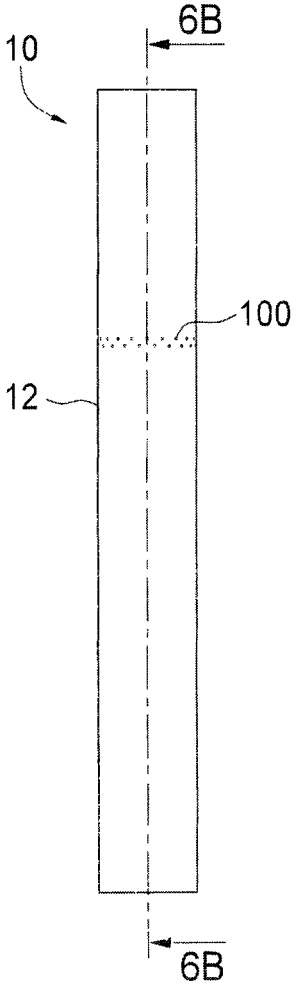
FIG. 6A is a front view of a HNB cigarette including a tobacco section that includes an airflow channel that does not extend to a bottom end of the tobacco section and includes a porous material in accordance with at least one example embodiment.
Figure 6B:
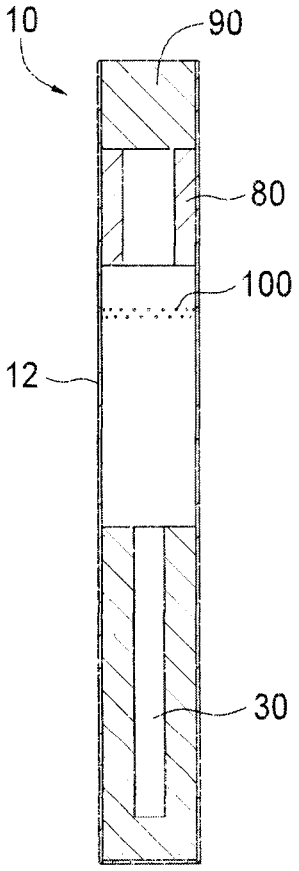
FIG. 6B is a cross-sectional view of the HNB cigarette of FIG. 6A taken along the line 6B-6B of FIG. 6A in accordance with at least one example embodiment.
Figure 6C:
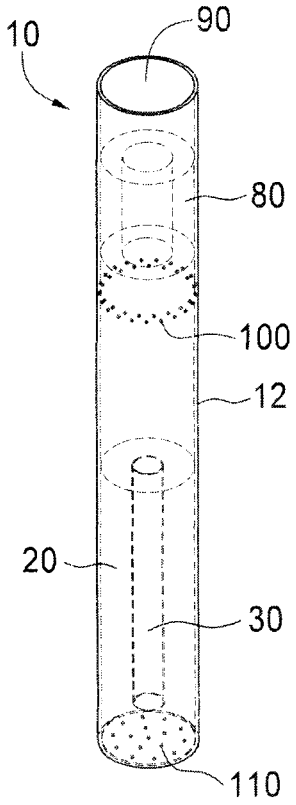
FIG. 6C is a perspective view of the HNB cigarette of FIG. 6A in accordance with at least one example embodiment.

FIGS. 6A to 6C illustrate an alternate embodiment wherein the at least one air flow channel 30 does not extend from the bottom end 50 of the tobacco section 20, but rather stops short of the bottom end 50. As shown, the bottom end 50 further comprises the porous material 110 for forming a seal and retaining the tobacco material within the tobacco section 20. The at least one air flow channel 30 may optionally not have any perforations. The second set of perforations 100 (which may optionally be used) are shown on the housing 12 adjacent or proximal to the hollow tube 80 for allowing the addition of cooler air.

Figure 7A:
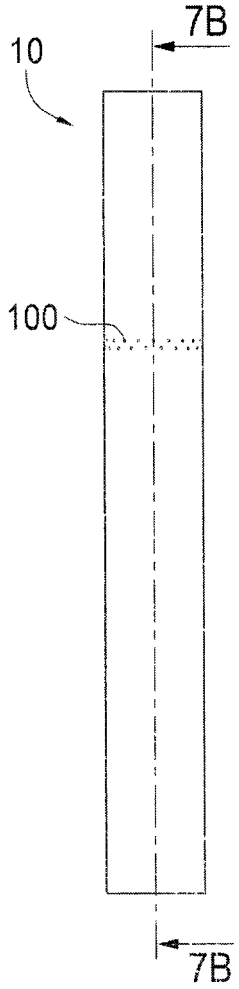
FIG. 7A is a front view of a HNB cigarette including a tobacco section with perforations, an airflow channel that does not extend to a bottom end of the tobacco section, and includes a porous material in accordance with at least one example embodiment.
Figure 7B:
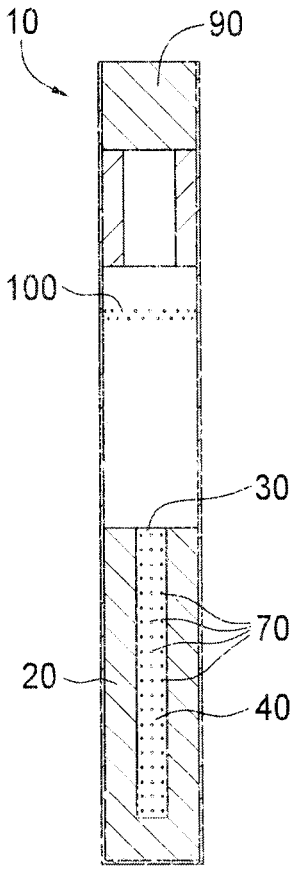
FIG. 7B is a cross-sectional view of the HNB cigarette of FIG. 7A taken along the line 7B-7B of FIG. 7A in accordance with at least one example embodiment.
Figure 7C:
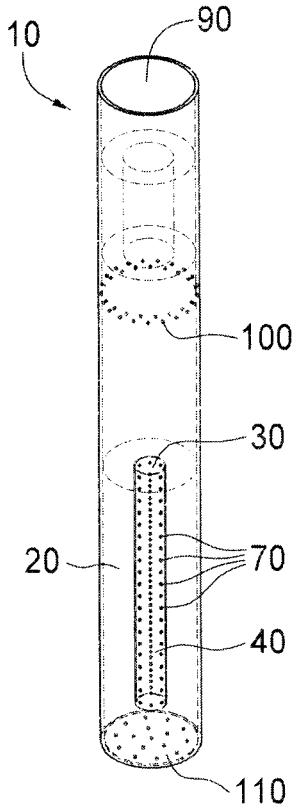
FIG. 7C is a perspective view of the HNB cigarette of FIG. 7A in accordance with at least one example embodiment.

FIGS. 7A to 7C show the perforations 70 in the inner tube 40 defining the air flow channel 30.

Figure 8A:
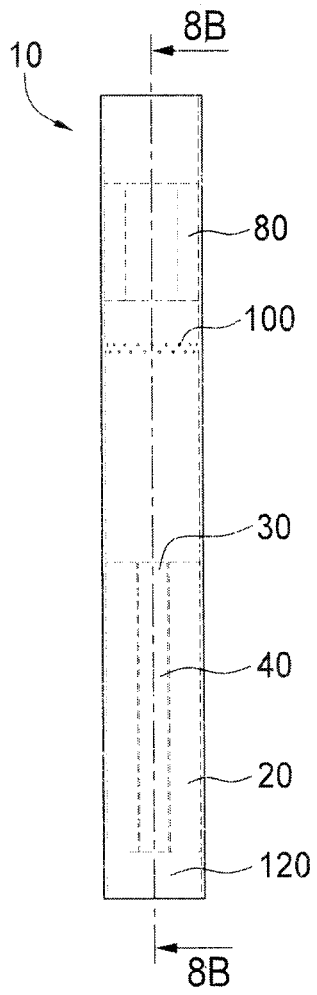
FIG. 8A is a front view of a HNB cigarette including the tobacco section of FIG. 1A and plug in accordance with at least one example embodiment.
Figure 8B:
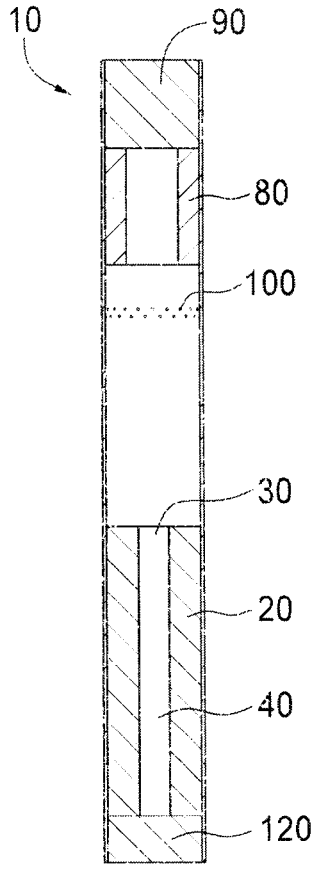
FIG. 8B is a cross-sectional view of the HNB cigarette of FIG. 8A taken along the line 8B-8B of FIG. 8A in accordance with at least one example embodiment.
Figure 8C:
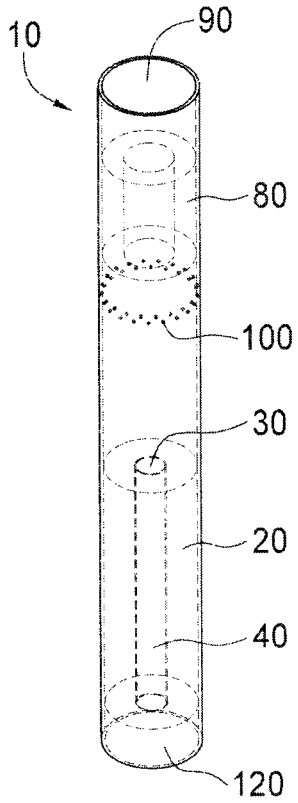
FIG. 8C is a perspective view of the HNB cigarette of FIG. 8A in accordance with at least one example embodiment.

Alternatively, in order to allow manufacturers to use current manufacturing methods, an embodiment as shown in FIGS. 8A to 8C may further comprise a plug or seal 120 operatively attached to the bottom end 50 of the tobacco section 20. The plug 120 may be a porous filter or other material that permits air to flow there through, but still substantially retain tobacco or other material within the tobacco section 20.

Figure 9A:
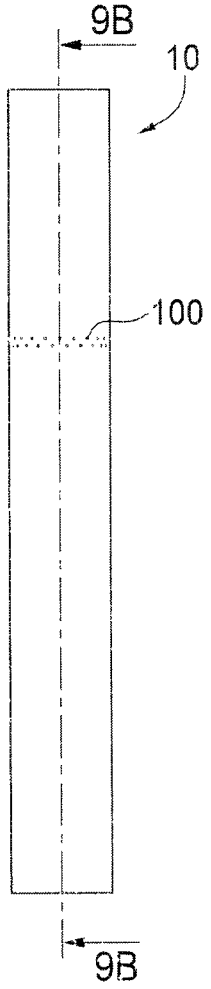
FIG. 9A is a front view of a HNB cigarette including the tobacco section of FIG. 2A and plug in accordance with at least one example embodiment.
Figure 9B:
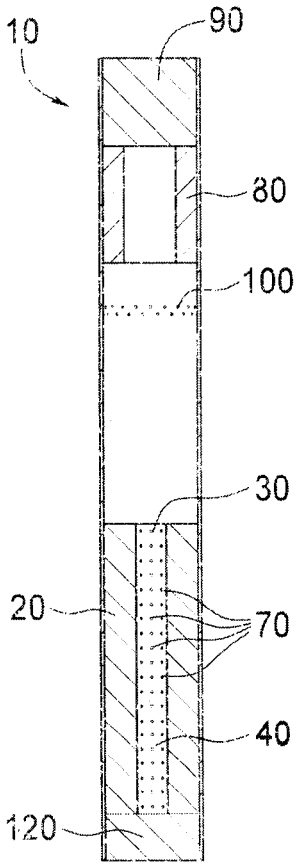
FIG. 9B is a cross-sectional view of the HNB cigarette of FIG. 9A taken along the line 9B-9B of FIG. 9A in accordance with at least one example embodiment.
Figure 9C:
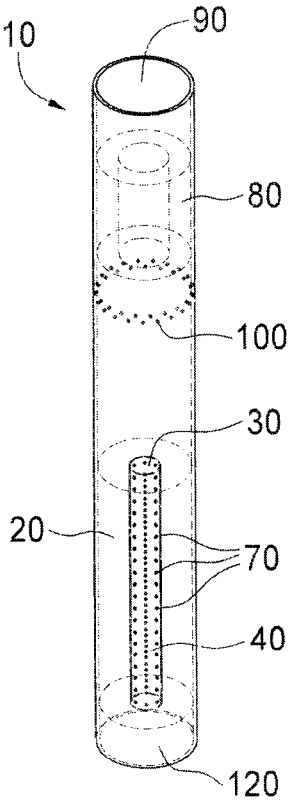
FIG. 9C is a perspective view of the HNB cigarette of FIG. 9A in accordance with at least one example embodiment.
Figure 10A:
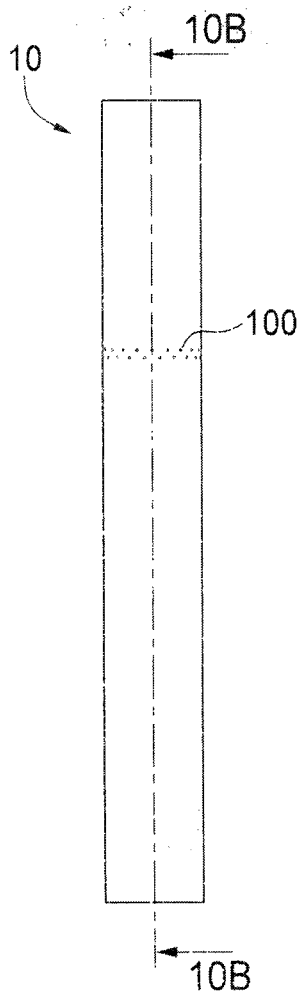
FIG. 10A is a front view of another HNB cigarette in accordance with at least one example embodiment.
Figure 10B:
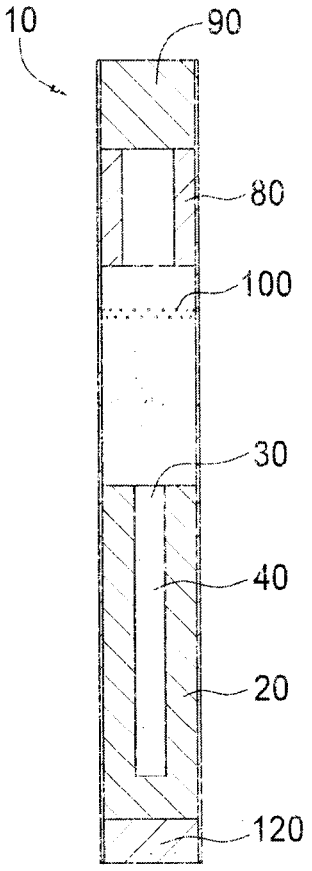
FIG. 10B is a cross-sectional view of the HNB cigarette of FIG. 10A taken along the line 10B-10B of FIG. 10A in accordance with at least one example embodiment.
Figure 10C:
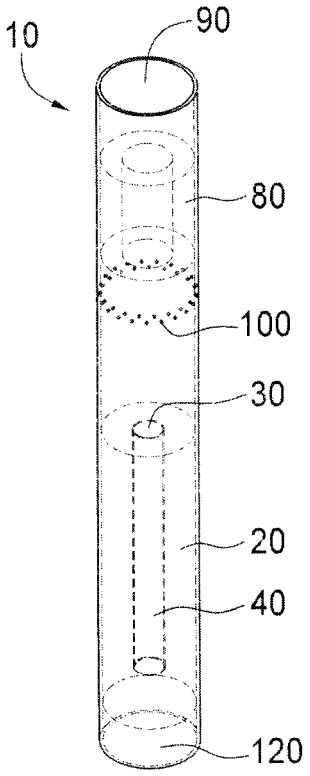
FIG. 10C is a perspective view of the HNB cigarette of FIG. 10A in accordance with at least one example embodiment.
Figure 11A:
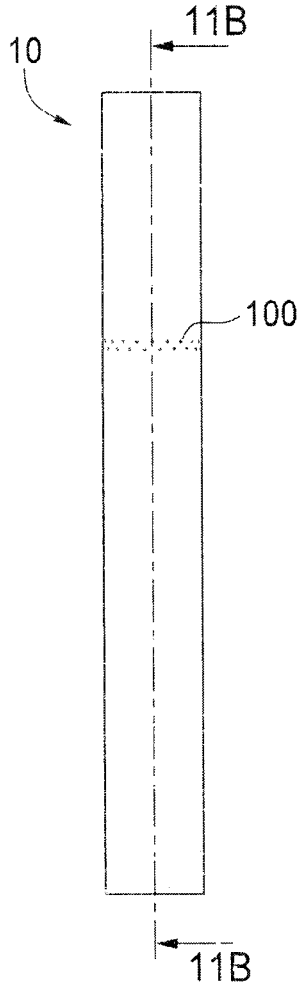
FIG. 11A is a front view of another HNB cigarette in accordance with at least one example embodiment.
Figure 11B:
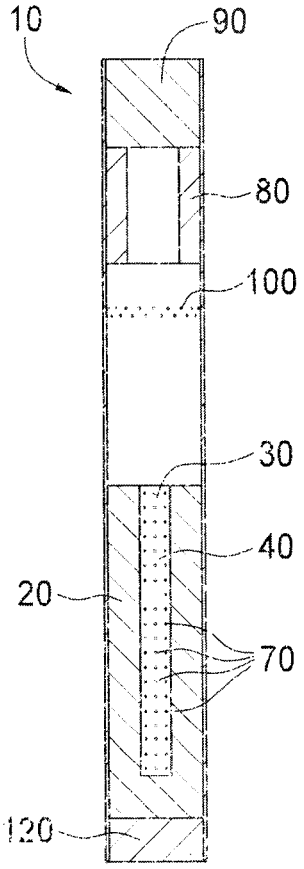
FIG. 11B is a cross-sectional view of the HNB cigarette of FIG. 11A taken along the line 11B-11B of FIG. 11A in accordance with at least one example embodiment.
Figure 11C:
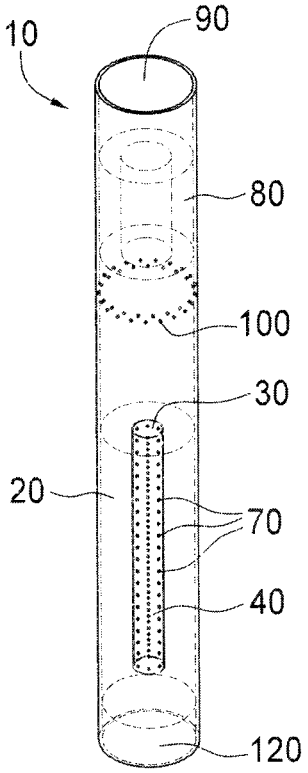
FIG. 11C is a perspective view of the HNB cigarette of FIG. 11A in accordance with at least one example embodiment.

FIGS. 9A to 9C show the perforations 70 in the hollow tube 40 defining the air flow channel 30.

FIGS. 10A to 10C and FIGS. 11A to 11C illustrate various embodiments having various combinations previously shown in FIGS. 8A to 8C and 9A to 9C.

Figure 12A:
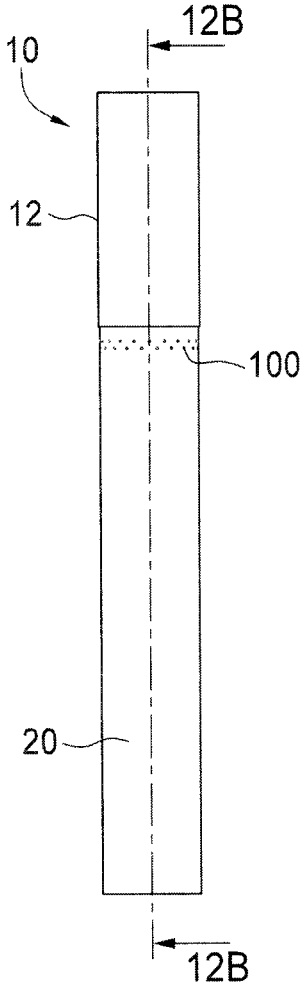
FIG. 12A is a front view of a HNB cigarette including the tobacco section of FIG. 1A and a cone disposed in a housing of the HNB cigarette in accordance with at least one example embodiment.
Figure 12B:
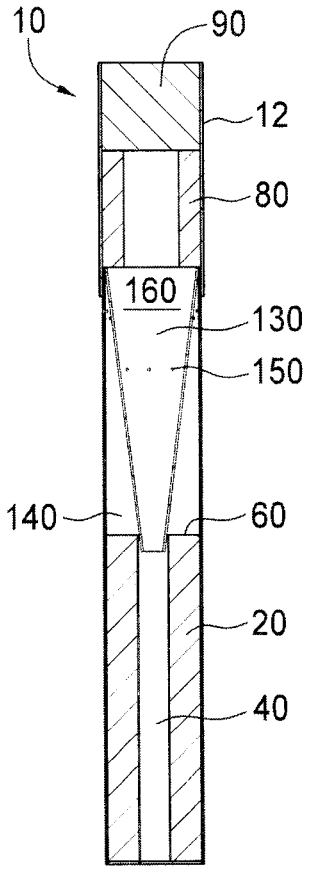
FIG. 12B is a cross-sectional view of the HNB cigarette of FIG. 12A taken along the line 12B-12B of FIG. 12A in accordance with at least one example embodiment.
Figure 12C:
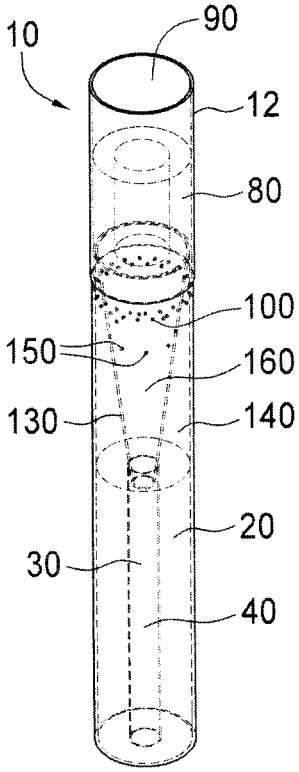
FIG. 12C is a perspective view of the HNB cigarette of FIG. 12A in accordance with at least one example embodiment.

In an embodiment, and as shown in FIGS. 12A to 12C, a cone (or inner cone) 130 is disposed within the housing 12 substantially inline and between the material for vaporization 20 and the outflow tube 80 or upper part 60 of the cigarette 10. The cone is an inverted frustro-conical shape. It is inverted when viewing the cigarette 10 when in a vertical position with the mouthpiece on the top or upper portion. The cone 130 is hollow, and its purpose is to provide space in the housing 12 of the cigarette 10 for inflow air to enter a closed bottomed cigarette on the side or at or proximal to the top end 60 through perforations or porous material and enter the cigarette, flow down the outer surface of the cone 130 into the tobacco section 20, mix with vapor, then be drawn upwards through the interior of the cone 130 and the tube 80, into the mouthpiece and the mouth of the user. The cone 130 creates an annular cavity 140 between its outer surface and the housing 12 of the HNB cigarette 10. The cone 130 further may, optionally, comprise interior perforations 150 which permit air within the annular cavity 140 to travel therefrom into an interior space 160 of the cone 130.

As shown, the second perforations 100 permit air to travel into the annular space 140 which is drawn into the tobacco section 20 and through the interior perforations 150.

Figure 13A:
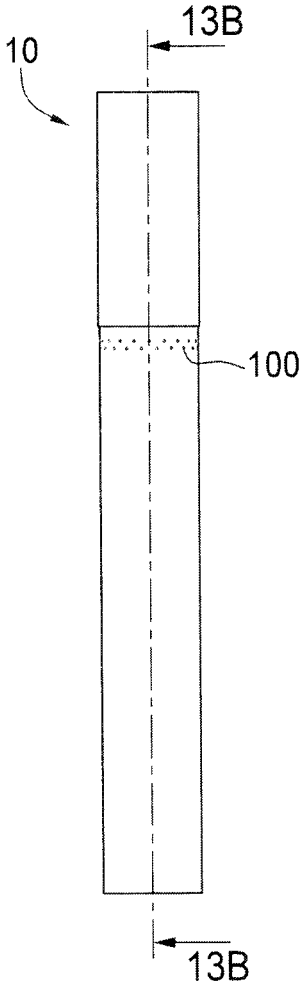
FIG. 13A is a front view of a HNB cigarette including the tobacco section of FIG. 2A and a cone disposed in a housing of the HNB cigarette in accordance with at least one example embodiment.
Figure 13B:
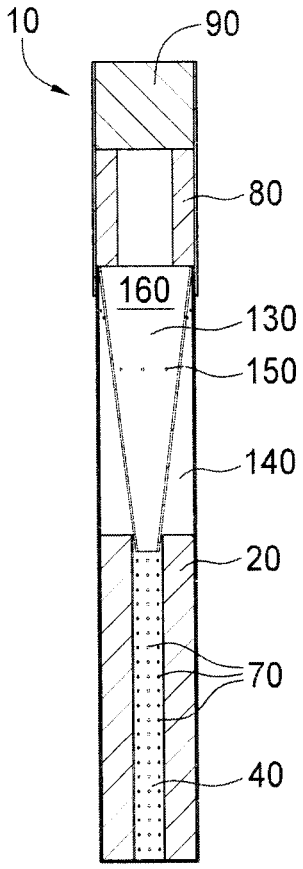
FIG. 13B is a cross-sectional view of the HNB cigarette of FIG. 13A taken along the line 13B-13B of FIG. 13A in accordance with at least one example embodiment.
Figure 13C:
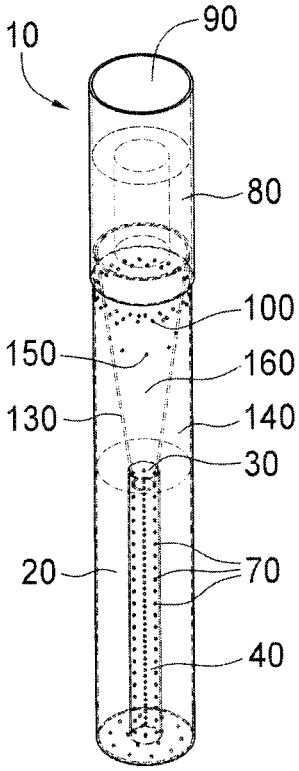
FIG. 13C is a perspective view of the HNB cigarette of FIG. 13A in accordance with at least one example embodiment.

In another embodiment, and as shown in FIGS. 13A to 13C, perforations 70 are disposed in the inner tube 40 defining the at least one air channel 30, thereby delivering higher concentrations of tobacco vapor to the operator, due to the optimized airflow. "Airflow" is used herein broadly to encompass the flow of both air and air mixed with vapor from heated tobacco or other dried plant materials such as oregano.

Figure 14A:
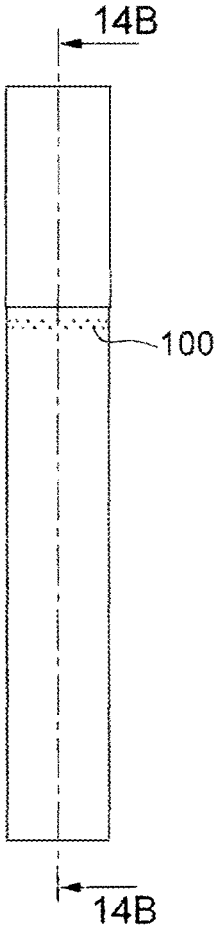
FIG. 14A is a front view of a HNB cigarette of FIG. 12A including a plug in accordance with at least one example embodiment.
Figure 14B:
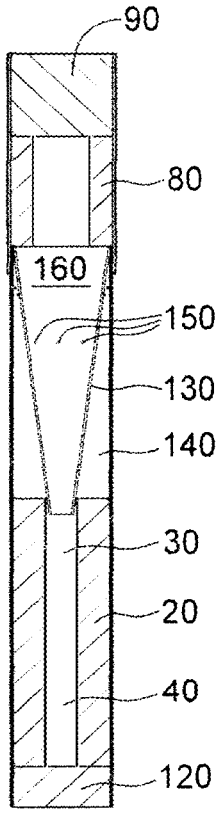
FIG. 14B is a cross-sectional view of the HNB cigarette of FIG. 14A taken along the line 14B-14B of FIG. 14A in accordance with at least one example embodiment.
Figure 14C:
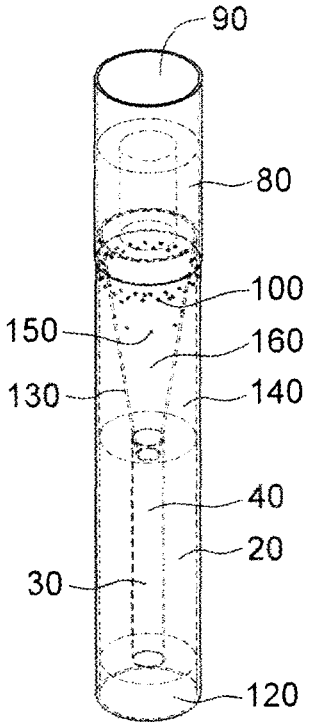
FIG. 14C is a perspective view of the HNB cigarette of FIG. 14A in accordance with at least one example embodiment.

FIGS. 14A to 14C illustrates an embodiment where the HNB cigarette 10 comprises the inner cone 130 and the filter plug 120.

Figure 15A:
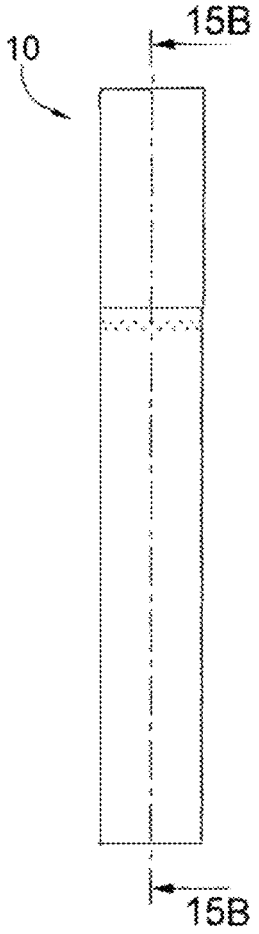
FIG. 15A is a front view of a HNB cigarette of FIG. 13A including a plug in accordance with at least one example embodiment.
Figure 15B:
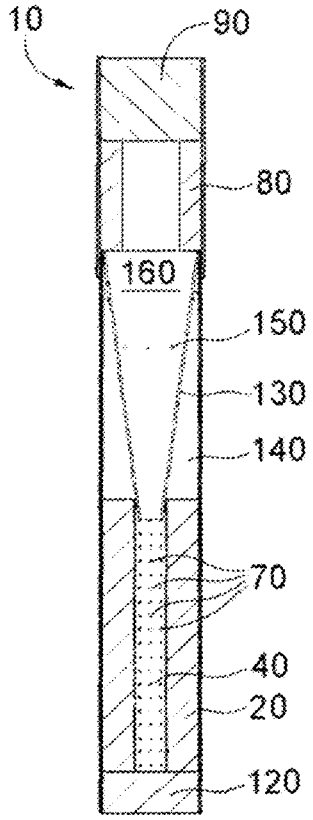
FIG. 15B is a cross-sectional view of the HNB cigarette of FIG. 15A taken along the line 15B-15B of FIG. 15A in accordance with at least one example embodiment.
Figure 15C:
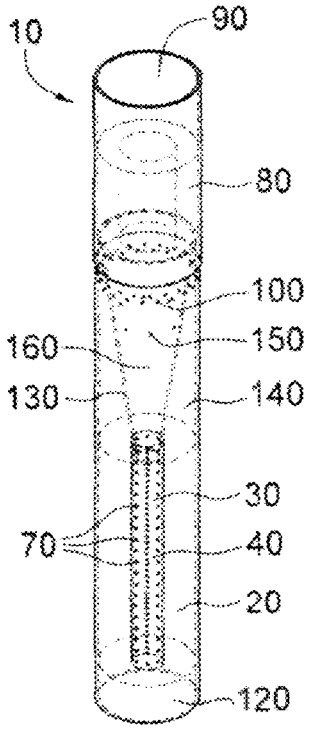
FIG. 15C is a perspective view of the HNB cigarette of FIG. 15A in accordance with at least one example embodiment.

In a preferred embodiment of the HNB cigarette 10, and as shown in FIGS. 15A to 15C, the inner tube 40 comprises perforations 70, the hollow tube 80 is proximate and fluidly connected to the cone 130, the cone 130 has perforations 150, and a filter plug 120 is provided.

Figure 16A:
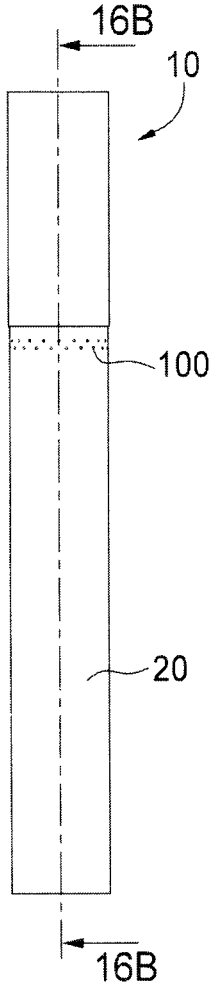
FIG. 16A is a front view of a HNB cigarette with a tobacco section within an airflow channel and tube in accordance with at least one example embodiment.
Figure 16B:
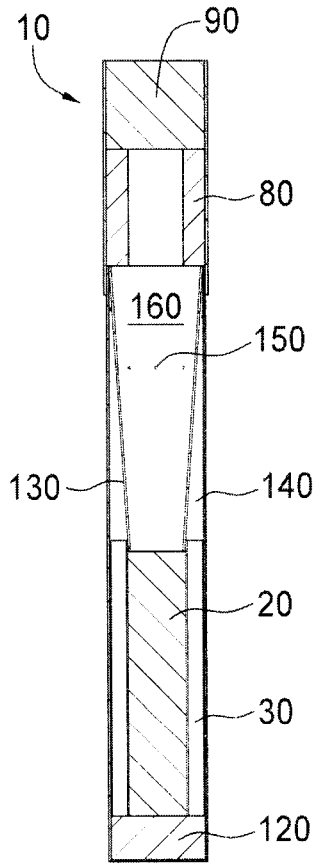
FIG. 16B is a cross-sectional view of the HNB cigarette of FIG. 16A taken along the line 16B-16B of FIG. 16A in accordance with at least one example embodiment.
Figure 16C:
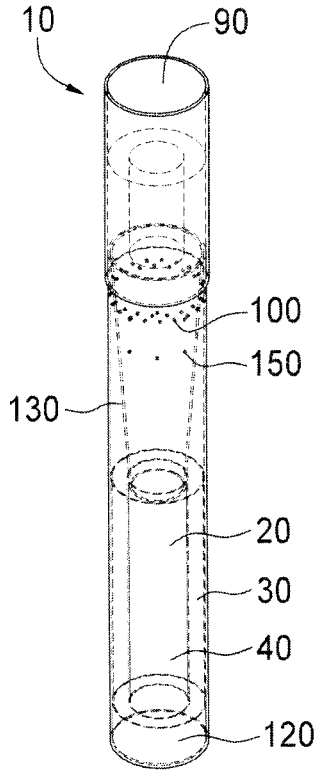
FIG. 16C is a perspective view of the HNB cigarette of FIG. 16A in accordance with at least one example embodiment.

In an alternate embodiment of the preferred embodiment, and as shown in FIGS. 16A to 16C, the tobacco section 20 is positioned within the at least one air flow channel 30 and tube 40.

Figure 17:
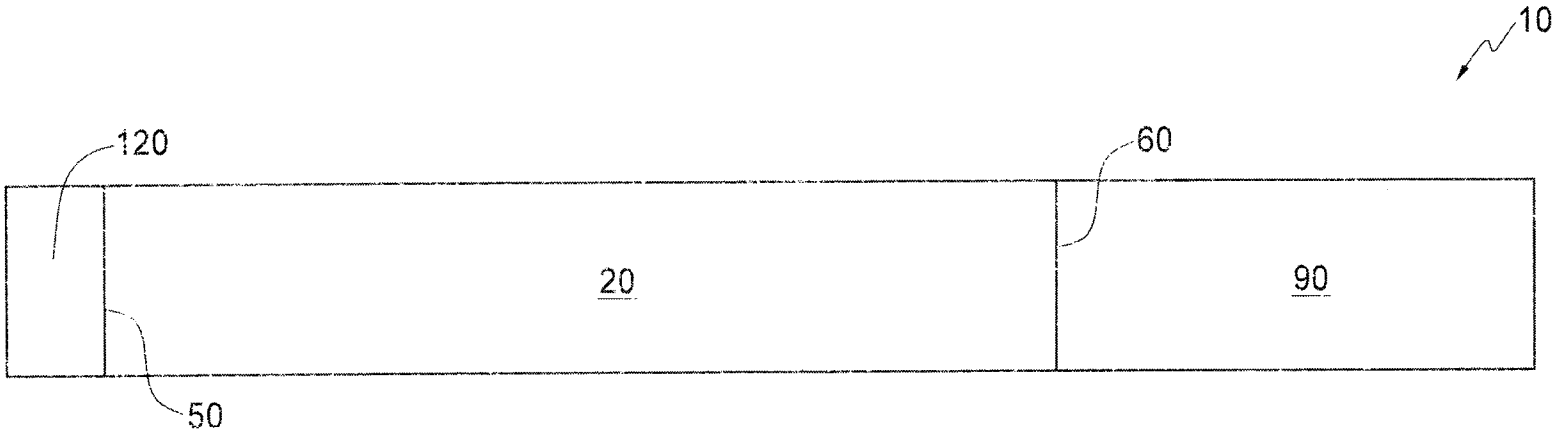
FIG. 17 is a front view of reduced cleaning HNB cigarette in accordance with at least one example embodiment.

As shown in FIG. 17, an embodiment of a reduced cleaning HNB cigarette 10 comprises a tobacco section 20 fluidly connected to a mouthpiece 90 at a top end 60 thereof, and fluidly connected to a plug 120 disposed at a bottom end 50 thereof. The plug 110 can be of any suitable porous material such to permit air to flow there through but prevent fine solid particulates from travel, or can be any suitable non-porous material having a plurality of perforations for permitting air flow there through. In embodiments, the plug 110 can be a filter, fibrous or otherwise, that can permit air to flow there through. In embodiments, the filter 110 can have different porosities which would allow a manufacturer to selectively choose the airflow through the HNB cigarette and also can allow a manufacturer to selectively choose the potency of the HNB cigarette by allowing more or less cooler ambient air to be mixed with the hot tobacco vapors.

Figure 18:
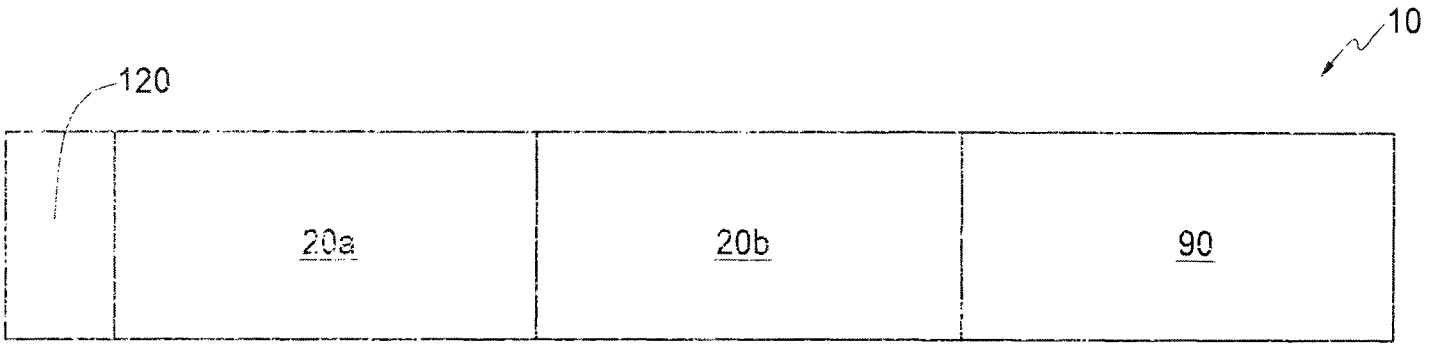
FIG. 18 is a front view of another reduced cleaning HNB cigarette including two tobacco sections in accordance with at least one example embodiment.

In an alternate embodiment, the reduced cleaning HNB cigarette 10 shown in FIG. 17 can comprise two or more tobacco sections 20. As shown in FIG. 18, the reduced cleaning HNB cigarette can comprise a first tobacco section 20 *a* and a second tobacco section 20 *b*. Each of the first and second tobacco sections 20 *a* and 20 *b* can be adapted to contain the same tobacco material, or different tobacco materials. The resulting multi-tobacco sectioned HNB cigarette can be used to create a combination of different tobacco flavors that an operator can experience by permitting different flavor to be combined. Tobacco should be understood to optionally include other dried plant material desired to be vaporized such as oregano.

Figure 19:
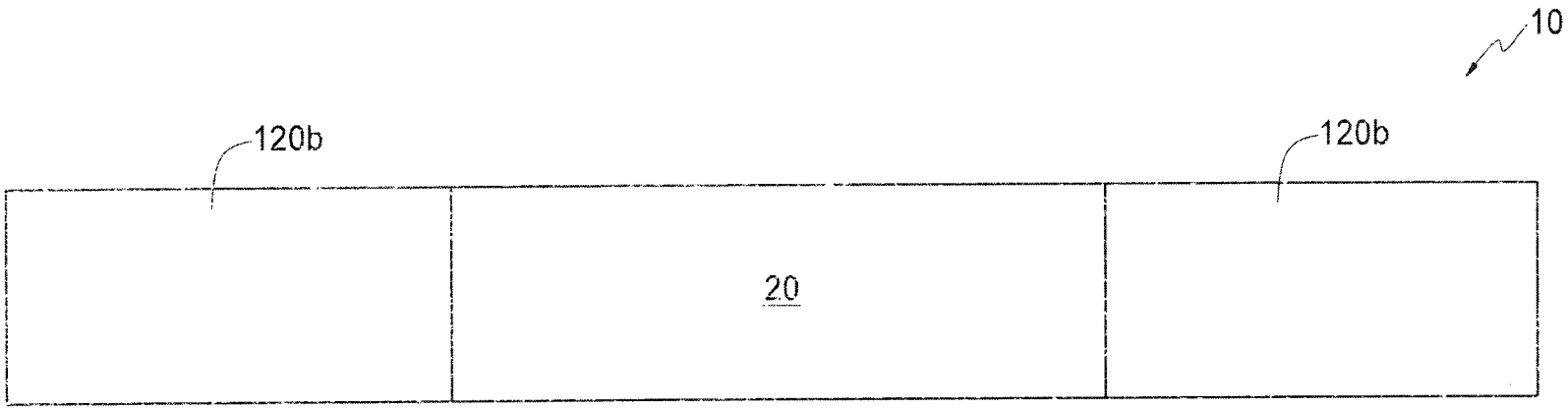
FIG. 19 is a front view of another reduced cleaning HNB cigarette including a tobacco section sandwiched between two filters in accordance with at least one example embodiment.

In an embodiment shown in FIG. 19, the tobacco section 20 can be sandwiched between a first filter 120 *a* having a first porosity and a second filter 120 *b* having a second porosity. In such an embodiment, an operator can insert the reduced cleaning HNB cigarette into a vaporizer to take advantage of the porosity of either the first or second filter 120 *a*, 120 *b*, or can flip the reduced cleaning HNB cigarette around to insert the other of the second or first filter 120 *b*, 120 *a* to take advantage of the porosity of the other second or first filter 120 *b*, 120 *a*. This embodiment could also be used with different flavors or other desirable characteristics such a smell, color, texture, or others, being applied to either or both of the first or second filters.

Figure 20:
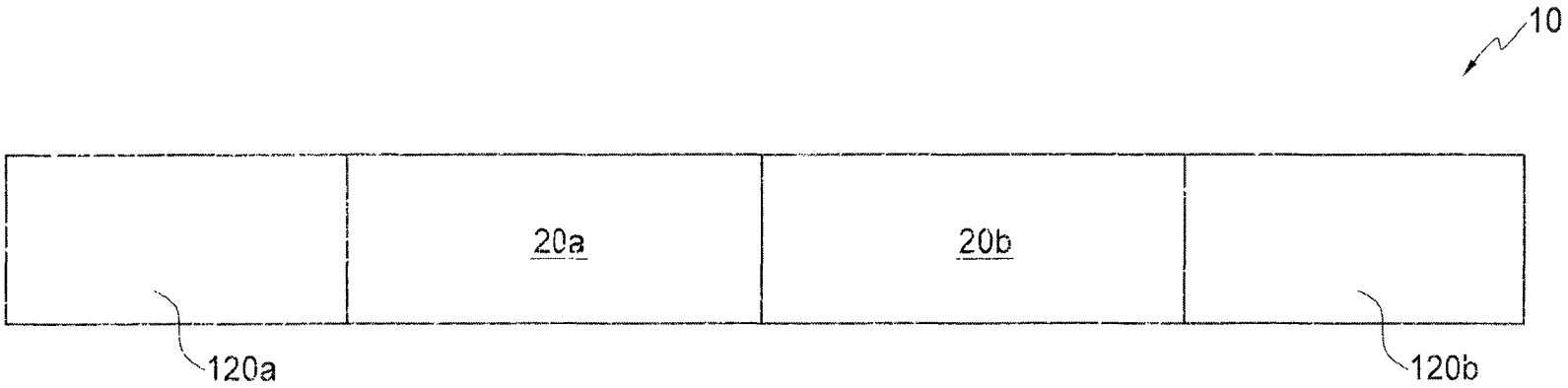
FIG. 20 is a front view of the HNB cigarette of FIG. 19 with two tobacco sections in accordance with at least one example embodiment.

FIG. 20 illustrates an embodiment of the reversible HNB cigarette in accordance with FIG. 19 further comprising two or more tobacco sections 20*a*, 20*b*.

Figure 21:
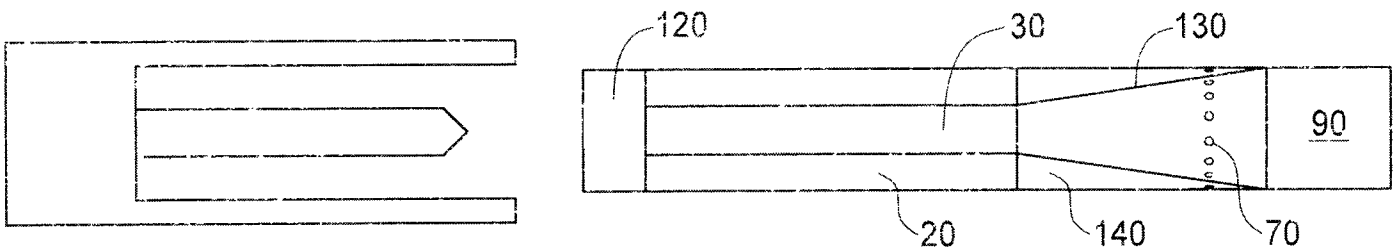
FIG. 21 is a front view of the HNB cigarette of FIG. 14A interacting with a vaporizer in accordance with at least one example embodiment.
Figure 22:
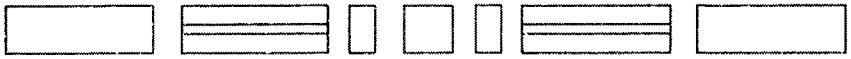
FIG. 22 illustrates a first step in a method of manufacturing a reduced cleaning HNB cigarette in accordance with at least one example embodiment.
Figure 23:
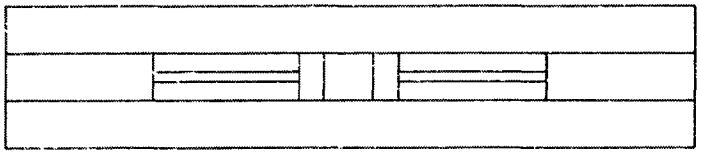
FIG. 23 illustrates a second step in a method of manufacturing a reduced cleaning HNB cigarette in accordance with at least one example embodiment.
Figure 24:
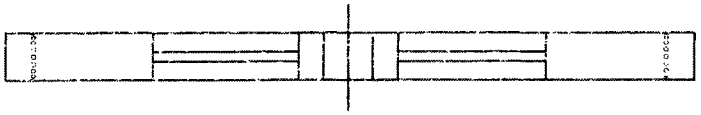
FIG. 24 illustrates a third step in a method of manufacturing a reduced cleaning HNB cigarette in accordance with at least one example embodiment.
Figure 25:
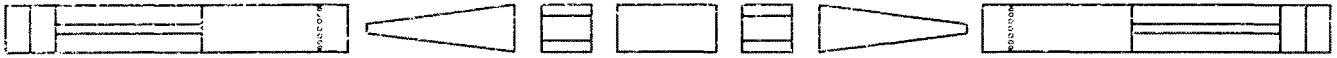
FIG. 25 illustrates a fourth step in a method of manufacturing a reduced cleaning HNB cigarette in accordance with at least one example embodiment.
Figure 26:
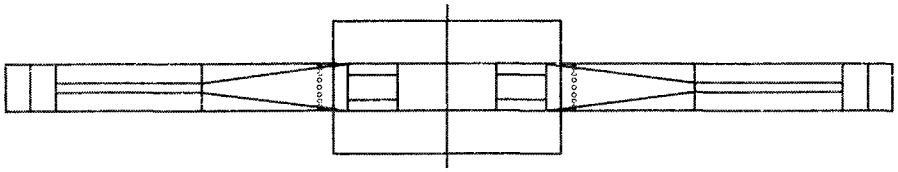
FIG. 26 illustrates a fifth step in a method of manufacturing a reduced cleaning HNB cigarette in accordance with at least one example embodiment.
Figure 27:
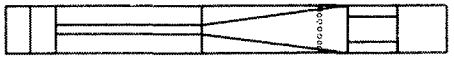
FIG. 27 illustrates a sixth step in a method of manufacturing a reduced cleaning HNB cigarette in accordance with at least one example embodiment.

With reference to FIGS. 14A to 14, and with reference to FIG. 21, embodiments of the reduced cleaning HNB cigarette can be adapted for use with vaporizers already publicly available, as can the other concepts disclosed herein. For example, the embodiment illustrated in FIGS. 14A to 14C can be used in vaporizers having a conventional oven as a heating element. The conventional oven can transfer heat to the tobacco section 20 to cause vaporization of the tobacco materials therein. For use with vaporizers having a heating element that is designed to stab into the tobacco section (such as the IQOS® HNB cigarette vaporizer), the filter plug 120 can be adapted to be pierced by the heating element, such that the heating element then is positioned within the at least one air flow channel 30 to provide heat from within the tobacco section 20. The concepts disclosed herein can also be used with a combination heating element, as disclosed herein.

With reference to FIGS. 22-27, an embodiment of the reduced cleaning HNB cigarette can be manufactured using the following method: In a first step, a long tobacco rod can be constructed with one or more air flow channels being disposed concentrically within the tobacco rod. In an embodiment, the one or more air flow channels can have perforations. The tobacco rod is then cut into multiple shorter sections. A filter plug can then be positioned between two adjacent cut sections of the tobacco rod, and two (2) hollow tubes can be positioned on each side of the exposed ends of the tobacco sections, with one tube being placed on either side. Subsequently, at least one layer of paper or other similar material can be used to join the multiple sections together, optionally by using a suitable adhesive. A laser perforator (or other mechanism for perforating) is then used to perforate the hollow tubes near the ends of each of the hollow tubes. Then the entire joined section is cut in half at about a midpoint of the filter plug, thereby separating the joined section into two equal sections. Each of these sections are rotated 180 degrees, such that the cut filter plug is now facing outwards instead of facing inwards. At this point, a cone is inserted into each of the hollow sections, with the smaller end of the hollow cone interfacing with the at least one airflow channel concentrically disposed within the tobacco containing section. Two (2) hollow tubes or filters are then positioned adjacent to each of the hollow tubes (with the hollow cone already inserted), followed by placing a mouthpiece between the hollow tube sections. Next, a wrap of tipping paper (or other similar material or adhesive or combination of paper and adhesive) that extends to the edge of the perforated holes on each of the hollow tubes is used to join the sections together. After joining, the joined tube is cut in half at the center of the mouthpiece filter section, which thereby completes the assembly of the HNB cigarette.

The various components described above can be aligned as shown, and secured to one another by wrapping at least one layer of tipping paper or other suitable material around the aligned components. The tipping paper may adhere to the substrate by using a suitable adhesive or by other suitable methods.

In a further embodiment, depicted in FIGS. 28-31, an advantageous design is provided which employs a closed-ended HNB cigarette with an outer 12 and inner capsule 14, and is IQOS® product compatible. The closed-ended HNB cigarette comprises an outer capsule 12 which contains the material to be vaporized at the closed end (bottom end 50) of the outer capsule 12, and another, smaller, inner capsule 14, having a perforated 70 bottom end 50. The bottom end of both capsules are, optimally, convex domes, which provides resistance to the heating spike, which in operation, is inserted into the bottom end 50 of the outer capsule 12. The convex dome structure has been found to slightly resist the insertion of the heating element, such that the resulting puncture is of an optimal diameter to permit air inflow to the HNB cigarette 10. In variations, other structures may be employed, such as a concave dome, or other similar structure. The perforated 70 bottom end 50 of the inner capsule 14 functions, in use, as a screen to stop the tobacco material 20 from falling out through the mouthpiece 90 or being inhaled by the user. In another embodiment, the filter 120 may optimally be inserted inside the inner capsule 14 to remove fine particulate from the tobacco vapor or to otherwise modify the properties or characteristics of the tobacco (or other material to be vaporized) vapor. In operation, the user presses the closed bottom end 50 of the cigarette 10 onto the heating spike 170 of the heating device 190, which pierces the end 50 of capsule 12 and penetrates into the tobacco material 20. The bottom 50 of the capsule 12 is closed until the heating spike/blade 170 of the heating unit 190 pierces the end 50 of the capsule 12. This embodiment doesn't have the same airflow passageway requirements as the closed bottom system, because the air inflow is just drawn in around the heating spike 170, through the pierced end of the capsule 12, then through the tobacco material 20, then through the perforated bottom 70 of the inner capsule 14, then through the filter 120, then out through the mouthpiece 90 into the user's mouth.

The closed bottom cigarette design is optimal for loose tobacco or any other material. The concentric capsules provide a way to retain the dried plant material without need for reconstitution. The material 20 to be heated to form an aerosol is then, in practice, pierced by the heating spike 170. The capsule 12 for containing the tobacco or other material such as hemp may be clear or opaque, but is advantageously clear for display purposes, i.e. the user can view the material to assess quality and quantity. The inner capsule 14 prevents the tobacco from exiting the tobacco-containing section in the bottom end 50 of the outer capsule 12. In another embodiment, the inner capsule 14 may consist of a screen, plug or filter 120. The inner capsule 14 or the screen 120 is secured in the cigarette by any known means, such as gluing to a ridge or side of the inner surface of the capsule 12 as the tobacco tends to press upwards on the screen section 120 when the spike 170 is inserted into it, and if the inner capsule 14 or the screen section 120 is not well secured then it can become dislodged. In one embodiment, the inner capsule 14 is secured inside the cigarette so that it doesn't become dislodged by locking nubs 16 built into the side of the outer capsule 12 and the side of the inner capsule 14 (not shown here) which permit easy assembly and serve to hold the inner capsule 14 securely in place. The dome-shaped (or similar to a dome shape—it could also be an inverted dome) end 50 on the capsule 12 section is important, as the dome functions very well for both ease of inserting the pod into the IQOS® device, and it works very well for the piercing application as the dome collapses in on itself at the pierce point, which makes small openings around the heating spike 170 that allow air to be drawn in around the heating spike 170. If the bottom end 50 to be pierced is flat, then the heating spike 170 may pierce through too neatly and doesn't permit sufficient air to enter the system for inhaling purposes. This embodiment of an HNB cigarette may optionally include one or more filter 120 sections installed in it for filtering, cooling, reducing the nicotine, flavoring, or otherwise modifying the vapor. Advantageously for certain organic material, the filtering is minimal or no filtering occurs at all, to ensure that the desirable effects from the aerosols produced by certain organic materials, are experienced by the user. The embodiment for such organic material, therefore, employs simply a permeable screen 120 rather than a filter 120. Additionally, the entire cigarette 10 (exclusive of the filter 120) is, optionally, comprised of fully biodegradable or compostable material.

By providing a method for controlling the air inflow and also a method for controlling the air outflow, the HNB cigarette manufacturer skilled in the art can controllably adjust the airflow of the HNB cigarette which allows the HNB cigarette to provide desirable vapor production characteristics to the user. Additionally, by placing a filter plug at the end of the tobacco containing section, the contamination of the heating element and heating element chamber can be reduced or eliminated.

The present invention thereby creates a structured cigarette, which may have at least one air flow channel, or multiple air flow channels, disposed in the tobacco, whether original or reconstituted, in such a way as to evenly heat the tobacco, resulting in an efficient vaporizing of the tobacco, and lowering the thermal mass of the tobacco used.

Figure 32A:
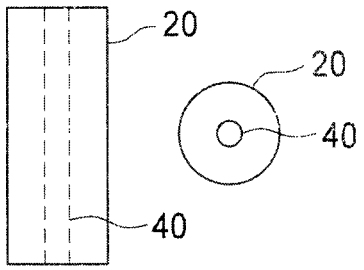
FIG. 32A illustrates a tobacco substrate and an inner hollow tube in accordance with at least one example embodiment.
Figure 32B:
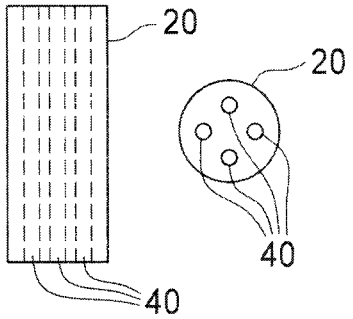
FIG. 32B illustrates a tobacco substrate and multiple inner hollow tubes in accordance with at least one example embodiment.
Figure 32C:
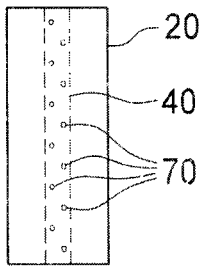
FIG. 32C illustrates a tobacco substrate and a perforated inner hollow tube in accordance with at least one example embodiment.
Figure 32D:
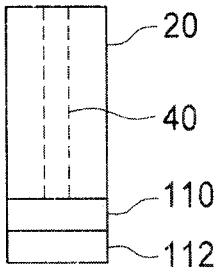
FIG. 32D illustrates a tobacco substrate with an inner hollow tube and a distal material including an impermeable material and a porous material in accordance with at least one example embodiment.

Referring again to the substrate 20, in FIG. 32A, the inner hollow tube 40 is shown in a plan view, and FIG. 32B shows multiple hollow tubes 40 being disposed in the substrate. The one or more tubes 40 may be perforated 70, as shown in FIG. 32C. Alternatively, as shown in FIG. 32D, the distal material may be impermeable material 112, thereby substantially blocking air flow, while the adjacent material may be porous 110, thereby enabling airflow down through the substrate 20, and back up through the substrate 20, optionally through different channels, but blocking airflow in or out of a bottom portion of the substrate 20. The different channels may be the hollow tubes 40. The porous material 110 is optional, and the substrate 20 may simply include an aerosol forming material and a substantially impermeable material 112. The perforations 70, the porous material 110 and impermeable material 112 may be employed in any of the designs disclosed in FIGS. 33-35, below, and in other embodiments disclosed herein.

In an alternative embodiment, the improved aerosol forming substrate section 20 to be used in an HNB cigarette 10 further comprises one or more hollow tubes 40, disposed axially (see FIG. 32B) in the aerosol forming substrate, and the one or more hollow tubes 40 may be perforated 70 (see FIG. 32C) to enhance airflow.

Figure 33A:
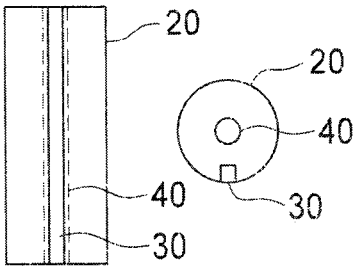
FIG. 33A illustrates a tobacco substrate with an inner hollow tube and an airflow groove in accordance with at least one example embodiment.
Figure 33B:
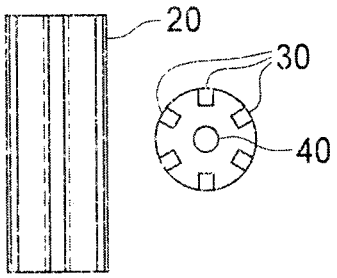
FIG. 33B illustrates a tobacco substrate with an inner hollow tube and a plurality of airflow grooves in accordance with at least one example embodiment.
Figure 33C:
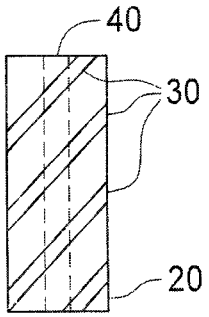
FIG. 33C illustrates a tobacco substrate with an inner hollow tube and a plurality of airflow grooves in a spiral pattern in accordance with at least one example embodiment.

FIG. 33*a* shows an airflow groove or channel 30 on the outer surface of the substrate 20 and an inner hollow tube 40. The tube 40 or airflow channel 30 may be of separate construction such as paper with the substrate formed thereabout, or it may be formed of the substrate itself, or it may be machined, cut or pressed in order to form the tube 40, providing for airflow 30. FIG. 33B depicts a substrate 20 with a plurality of grooves or channels 30 disposed in the surface of the substrate 20. The channels 30 may be spiral in formation (FIG. 33*c*) or other patterns.

Figure 34:
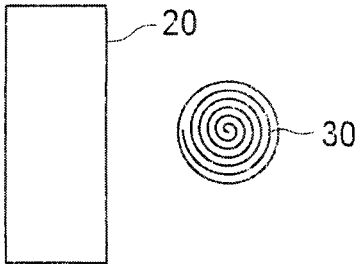
FIG. 34 illustrates a tobacco substrate formed from a roll of reconstituted tobacco in accordance with at least one example embodiment.

FIG. 34 shows a substrate formed from a roll of reconstituted tobacco or other aerosol generating substrate 20. In operation, the airflow 30 passes through the loosely packed layers of reconstituted aerosol generating substrate.

Figure 35:
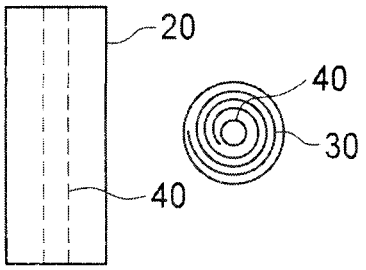
FIG. 35 illustrates a tobacco substrate formed from a roll of reconstituted tobacco including a hollow inner tube in accordance with at least one example embodiment.

FIG. 35 shows a substrate formed from a roll of reconstituted tobacco or other aerosol generating substrate 20, with a dedicated hollow inner tube my be formed by gluing an inner roll of the substrate 20 into a tube, forming substantially an elongated cylinder which passes through or forms the core of the substrate. Also the substrate may be rolled around a tube 40 to form the inner core. In operation, the airflow 30 passes through the loosely packed layers of reconstituted aerosol generating substrate and the hollow tube 40.

Figure 36A:
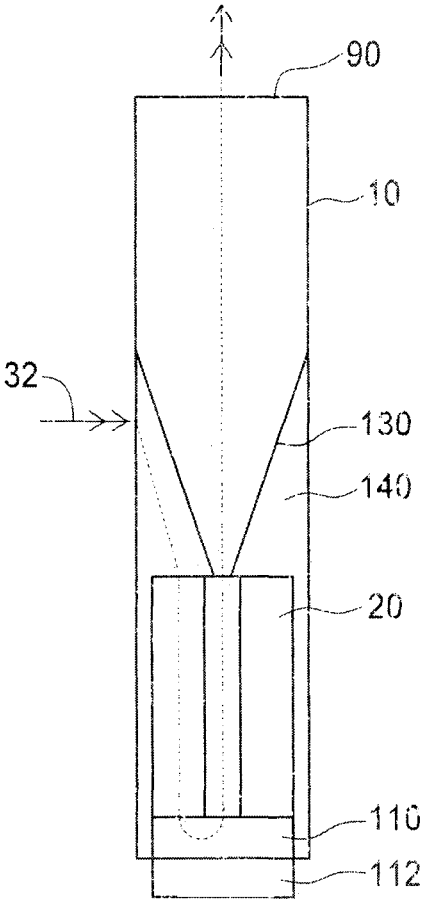
FIG. 36A illustrates an interior of a HNB cigarette in accordance with at least one example embodiment.
Figure 36B:
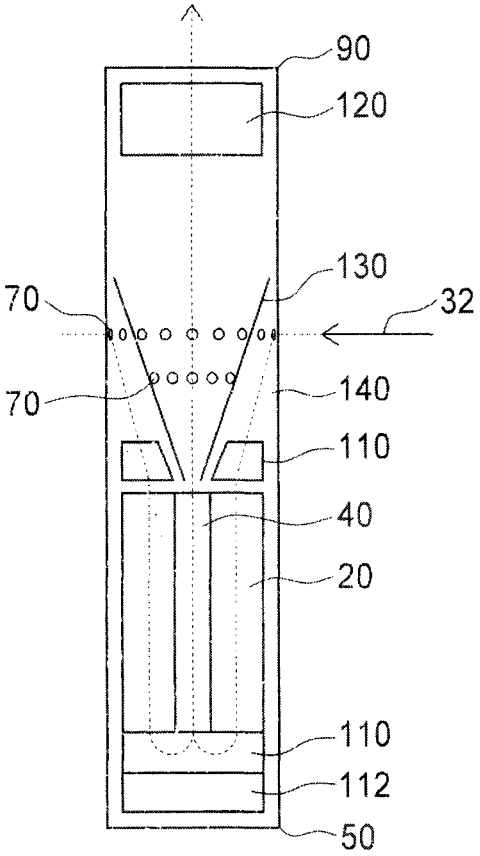
FIG. 36B illustrates an interior of the HNB cigarette of FIG. 36A with perforations on a cone and a filter disposed at a proximal end in accordance with at least one example embodiment.

In an alternative embodiment shown in FIG. 36A, the interior of an improved HNB cigarette further comprises at least one cone 130 or other similar structure (i.e. a funnel or other frustro-conical curved or straight sided hollow shape) which deflects airflow in order to direct airflow into or out of the substrate 20, for instance, in a closed bottom HNB cigarette, where air is drawn from the side of the cigarette 10. An example of optimal airflow 32 is depicted by a dotted line to show airflow entering on a side of the cigarette, including circumferentially, passing down through the annular cavity outside of the cone 130 in the cigarette 10, through the substrate 20, optionally through a porous material 110, then back up through a hollow tube 40 in the substrate, through the cone 130 and to the mouthpiece 90. The impermeable material 112 blocks airflow in or out of the distal (from the user) end of cigarette 10 in this embodiment. The at least one cone or other similar structure may be fluidly connected at one end of the cone to the aerosol forming substrate or to one of more airflow pathways in the aerosol forming substrate 20, and at the other end to a filter or to the mouthpiece 90 of the HNB cigarette. The at least one cone or other similar structure may be disposed within a hollow tube section, thereby creating an annular cavity 140 between the interior of the hollow tube section and the exterior of the cone or other similar structure. Optionally, a porous material 110 (which could be a disk or toroidal/donut shaped), may be disposed on the proximal end of the substrate 20, in order to block detritus or debris entering the annular cavity 140, thereby maintaining an open airflow path. FIG. 363 shows perforations on the cone 130 and on the exterior of the side of the cigarette 10. FIG. 36B also depicts the optional filter 120 disposed in the cigarette 10 at the proximal (to the user) end. The optimal or primary airflow path 32 is shown in a dotted line. Air inflow is initially through the exterior perforations 70 radial to the cigarette about potentially the entire circumference, then turns to the axial direction towards the bottom 50 or distal end from the user through the substrate 20 through at least one channel 30, then rotates about 180 degrees and flows through the hollow tube 40 in the substrate 20, towards the top end 60 of the cigarette 10. At the same time, some air will tend to flow in through the external perforations 70 and directly through the cone 130 perforations 70 and mixes with the hot vapor to reduce its temperature, and importantly, adjusts the pressure of the airflow in the widening conical area, thereby avoiding condensation of the vapour. As the area across the come 130 expands, the pressure drops, necessitating an influx of air. The direct inflow from the exterior of the cigarette through the cone 130 provides this compensating influx.

Either or both of the hollow ube section 40 and the cone section 130 may be perforated to permit air inflows or outflows or to provide an improved method for reducing the temperature of the aerosol. The perforations may also serve to reduce the pressure drop either upstream or downstream from one or more filter sections or the mouthpiece of the HNB cigarette 10.

In an alternative embodiment, the HNB cigarette may utilize a cone or other similar structure disposed within a HNB cigarette 10, where the narrow end of the cone is fluidly connected, to an hollow tube 40 within the downstream end of the aerosol forming section 20 with one or more disks or other shapes of porous 110 and/or impermeable 112 materials disposed on the upstream end of the aerosol forming section 20. The wide end of the cone 130 is sealingly attached inside the HNB cigarette 10 and fluidly connected to a filter 120 or the mouthpiece 90, with perforations 70 or other openings being disposed on the exterior of the HNB cigarette 10 that permit air to be drawn into the annular cavity 140 between the outside surface of the cone 130 and the inside surface of the HNB cigarette 10 with the air subsequently being drawn through the aerosol forming section 20 in a direction that is opposite to the mouthpiece 90 until the air (now containing aerosol from the aerosol generating substrate 20) reaches the end of the aerosol generating substrate section 20 and passes through the porous filter section 110 at the distal end 50 of the HNB cigarette 10 and subsequently the air is drawn up through the airflow pathway 40 disposed within the aerosol generating substrate 20 towards the mouthpiece of the HNB cigarette 10, where the aerosol is drawn through the interior of the cone 130 (which may have additional perforations for mixing cooler exterior air into the aerosol) and out through the filter 110 and mouthpiece 90 and is inhaled by the user.

In an alternative embodiment depicted in FIG. 37L, the HNB cigarette 10 comprises two concentric open ended capsules 12 and 14 adapted to contain one or more aerosol forming substrates 20 between the capsules. One or more of the capsules may be optimally adapted to be pierced by a pin or blade type of heating element, which thereby creates an air inflow channel into the aerosol forming substrate. In an alternative embodiment, one or more of the concentrically or coaxially disposed capsules may be adapted to have perforations or other openings to permit airflow through the aerosol forming substrate, with or without piercing of one or more of the capsules by a heating element, with such perforations serving to reduce or eliminate material easily falling out of the open end of the HNB cigarette onto or into or around the heating element or into or onto or around the chamber in the HNB device enclosing the heating element. The capsules are essentially tubes with one closed end and one open end.

FIG. 37A shows an inner capsule 14 with a blunt face or tip, and an outer capsule 12 with a convex head, tip or face, which is optimally adapted to receive a pin, sword, or blade type heating element 170. FIG. 371B shows two convex heads on the capsules. FIG. 37C shows an inner capsule 14 with a concave head. FIG. 37D shows a filter 120 which in other embodiments may simply be a space, as it is not essential that the inner capsule 14 extend to the upper end 60 of the cigarette 10. One or more filters and/or a mouthpiece 90 may be disposed inside the inner capsule 14, inside the outer capsule 12, or at the exterior end of the HNB cigarette 10. FIG. 37E shows the embodiment with the inner capsule 14 rotated such that the open end is disposed towards the bottom end 50 of the HNB cigarette FIG. 37F shows the locking nubs 16 retaining flat tipped capsules in place. The locking nubs 16 may be employed with any of the various embodiments. Nubs 16, ridges, fasteners and or heating, gluing, crimping or any other means of affixing the capsules together may be used with any of the embodiments disclosed herein. FIGS. 37Gg and 37H depict perforations 70 disposed on the end of the inner capsule 14. The perforations 70 can be disposed on the head or tip of the inner and outer capsules or either. Such perforations may be used in combination with other perforations 70 on the exterior of the HNB cigarette 10 to mix in cooler external air which functions to cool the vapour temperature and/or modify the air pressure. This also avoids the condensation effect. FIGS. 37I and 37J show perforations 70 disposed on tip of the inner capsule 14 and the outer capsule 12. The embodiments depicted in FIGS. 37I and 37J are adapted to be used with either the internal pin sword or blade style heater 170 or the external heater 172 style HNB devices or the combination-heater disclosed herein. FIG. 37K shows an outer capsule 12 with a screen or filter of porous material 110 or other retaining device which obviates the need for an inner capsule 14 by retaining the aerosol generating substrate 20. Any known means may be used to secure the retainer 110 in place.

Figure 38A:
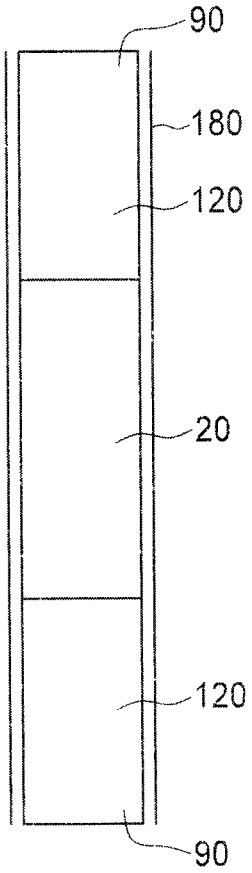
FIG. 38A illustrates another embodiment of a HNB cigarette including an aerosol forming substrate sandwiched between filters and wrapped in cigarette paper in accordance with at least one example embodiment.
Figure 38B:
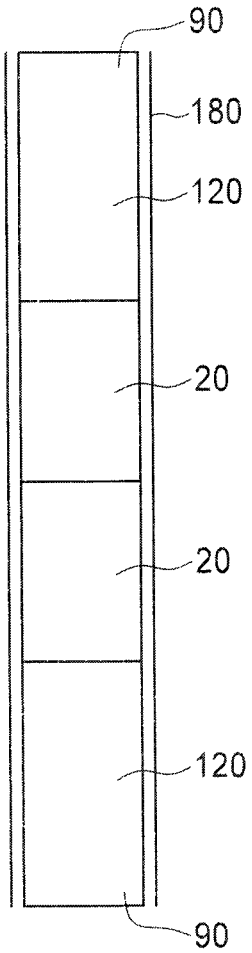
FIG. 38B illustrates another embodiment of a HNB cigarette including two aerosol forming substrates sandwiched between filters and wrapped in cigarette paper in accordance with at least one example embodiment.

As shown in FIG. 38A, in an alternative embodiment of the HNB cigarette 10, one or more sections of aerosol forming substrates 20 may be wrapped and joined with cigarette paper, tipping paper, or other suitable materials 180, which are then are abutted on both ends by filters 120 or mouthpieces 90, or hollow tubes, structures, spacers or other materials which may be porous, semi-porous, or impermeable to air, and the entire assembly may be joined by wrapping the entire assembly with cigarette paper, tipping paper, or other suitable materials, or by other joining methods. The cigarette may include voids or spaces between some or all components. In this embodiment, the filters or mouthpieces may serve to; reduce or eliminate the ability of the aerosol forming substrates to exit the HNB cigarette before, during, or after use; to modify, restrict, or otherwise alter the airflow through the HNB cigarette; to provide a reversible HNB cigarette with different flavors or other properties being optionally selected by the operator by choosing which end to insert into the HNB device; or to permit loose aerosol forming substrates to be effectively utilized in the HNB cigarette. One filter may have radial perforations, and the other filter on the opposite end of the reversible cigarette 10 may have none, or the perforations on each end could be of different sizes, or the filters themselves could be different densities, flavors or materials or lengths (these features are together called parameters). Therefore there is, in this embodiment, a first and second end of a reversible cigarette, with different properties, which the user can select at his or her option. In operation, the user inserts the end with the designated properties he or she desires. The user would, for instance, insert the end with the heavier or denser filter first, to get a lighter aerosol experience. The tipping paper on each cigarette section may include a printed label, colour, notice or indication of the properties of each filter, substrate section or mouthpiece or end of the cigarette and which end to insert to take advantage of the desired property or properties. Any combinations or permutations of the above components may be assembled to create this customized reversible HNB cigarette. End components such as filters can be selectively removed by the user, optionally with break lines or stippling or other incorporated weakness to assist the user to remove the unwanted section or sections. FIG. 38B shows two different substrate sections 20.

Information as herein shown and described in detail is fully capable of attaining the above-described object of the present disclosure, the presently preferred embodiment of the present disclosure, and is, thus, representative of the subject matter which is broadly contemplated by the present disclosure. The scope of the present disclosure fully encompasses other embodiments which may become obvious to those skilled in the art, and is to be limited accordingly, by nothing other than the appended claims, wherein any reference to an element being made in the singular is not intended to mean "one and only one" unless explicitly so stated, but rather "one or more." All structural and functional equivalents to the elements of the above-described preferred embodiment and additional embodiments as regarded by those of ordinary skill in the art are hereby expressly incorporated by reference and are intended to be encompassed by the present claims.

Moreover, no requirement exists for a system or method to address each and every problem sought to be resolved by the present disclosure, for such to be encompassed by the present claims. Furthermore, no element, component, or method step in the present disclosure is intended to be dedicated to the public regardless of whether the element, component, or method step is explicitly recited in the claims. However, that various changes and modifications in form, material, work-piece, and fabrication material detail may be made, without departing from the spirit and scope of the present disclosure, as set forth in the appended claims, as may be apparent to those of ordinary skill in the art, are also encompassed by the present disclosure.

The exemplary embodiments herein described are not intended to be exhaustive or to limit the scope of the disclosure to the precise forms disclosed. They are chosen and described to explain the principles of the disclosure and its application and practical use to allow others skilled in the art to comprehend its teachings.

As will be apparent to those skilled in the art in light of the foregoing disclosure, many alterations and modifications are possible in the practice of this disclosure without departing from the scope thereof.

The invention claimed is:

1. An aerosol forming substrate for a smoking article comprising at least one air channel which runs substantially through the aerosol forming substrate, wherein the aerosol forming substrate is comprised of at least one sheet of reconstituted tobacco rolled to form a substantially cylindrical tube which is disposed substantially longitudinally through the aerosol forming substrate and the substantially cylindrical tube includes perforations, the air channel being disposed directly on an outer surface of the aerosol forming substrate.

2. The aerosol forming substrate of claim 1, wherein at least one additional air channel is disposed on an outside of the aerosol forming substrate.

3. The aerosol forming substrate of claim 1, further comprising a plurality of substantially cylindrical tubes is disposed within the aerosol forming substrate.

4. The aerosol forming substrate of claim 1, wherein the perforations extend along a longitudinal length of the substantially cylindrical tube.

5. A cigarette comprising:

an outer capsule defining a chamber receiving the aerosol forming substrate of claim 1, and an inner capsule inserted coaxially in the outer capsule, the inner capsule including the aerosol forming substrate, wherein the aerosol forming substrate is fluidly connected to a mouthpiece of the cigarette.

6. The cigarette of claim 5, wherein a hollow cone is connected to the inner capsule and the hollow cone is fluidly connected to the aerosol forming substrate.

7. The cigarette of claim 5, further comprising at least one material to be vaporized disposed between two mouthpieces located at opposite ends of the cigarette.

8. The cigarette of claim 5, wherein the inner capsule has perforations on an end of the inner capsule.

9. The cigarette of claim 5, wherein a bottom of the outer capsule has a dome shaped end.

10. The cigarette of claim 5, wherein the outer capsule is fluidly connected to the mouthpiece.

11. The cigarette of claim 5, wherein the inner capsule is fluidly connected to the mouthpiece.

12. The cigarette of claim 5, wherein the mouthpiece comprises at least one filter.

13. The cigarette of claim 5, wherein the mouthpiece comprises a hollow tube.

14. The cigarette of claim 5, wherein the inner capsule is affixed inside the outer capsule.

15. The cigarette of claim 5, wherein the inner capsule is removably affixed inside the outer capsule.

16. The cigarette of claim 5, wherein the inner capsule comprises a screen.

* * * * *